US009440714B2

(12) United States Patent
Robinson

(10) Patent No.: US 9,440,714 B2
(45) Date of Patent: Sep. 13, 2016

(54) FORWARD PROPELLED HOVER BOARD

(71) Applicant: Brandon Robinson, Fruitland Park, FL (US)

(72) Inventor: Brandon Robinson, Fruitland Park, FL (US)

( * ) Notice: Subject to any disclaimer, the term of this patent is extended or adjusted under 35 U.S.C. 154(b) by 0 days.

(21) Appl. No.: 14/834,814

(22) Filed: Aug. 25, 2015

(65) Prior Publication Data

US 2015/0360755 A1 Dec. 17, 2015

Related U.S. Application Data

(63) Continuation of application No. 14/066,997, filed on Oct. 30, 2013, now Pat. No. 9,145,206.

(60) Provisional application No. 61/720,791, filed on Oct. 31, 2012.

(51) Int. Cl.

| | |
|---|---|
| ***B63B 35/73*** | (2006.01) |
| ***B64C 39/00*** | (2006.01) |
| ***B63B 9/00*** | (2006.01) |
| ***B63H 11/04*** | (2006.01) |
| ***B63H 21/22*** | (2006.01) |
| ***B63H 23/26*** | (2006.01) |
| ***B63H 11/107*** | (2006.01) |
| *B63H 11/00* | (2006.01) |

(52) U.S. Cl.

CPC ..... *B63B 35/73* (2013.01); *B63B 9/00* (2013.01); *B63B 35/731* (2013.01); *B63H 11/04* (2013.01); *B63H 11/107* (2013.01); *B63H 21/22* (2013.01); *B63H 23/26* (2013.01); *B64C 39/00* (2013.01); *B63H 2011/006* (2013.01); *B63H 2011/008* (2013.01)

(58) Field of Classification Search

CPC ..... B63B 35/73; B63B 35/731; B63B 9/00
See application file for complete search history.

(56) References Cited

U.S. PATENT DOCUMENTS

| | | | | |
|---|---|---|---|---|
| 5,947,788 | A | 9/1999 | Derrah | |
| 2012/0226394 | A1 | 9/2012 | Marcus | |
| 2013/0068895 | A1* | 3/2013 | Zapata | B64C 39/026 244/23 A |
| 2014/0103165 | A1 | 4/2014 | Zapata | |
| 2014/0332634 | A1* | 11/2014 | Li | B64C 39/026 244/23 A |
| 2014/0332635 | A1* | 11/2014 | Weider | B64C 39/026 244/23 A |
| 2015/0158567 | A1* | 6/2015 | Zapata | B63B 35/73 440/38 |

FOREIGN PATENT DOCUMENTS

| | | | |
|---|---|---|---|
| CA | WO9633091 | A1 | 10/1996 |
| EP | 2837560 | A1 | 2/2015 |
| EP | 2842864 | A1 | 3/2015 |
| FR | WO/2013/041786 | A1 | 3/2013 |
| FR | WO/2013/041787 | A1 | 3/2013 |

* cited by examiner

*Primary Examiner* — Justin Benedick
(74) *Attorney, Agent, or Firm* — Patent Law Offices of Rick Martin, P.C.

(57) ABSTRACT

A forward water propelled hover board comprising a rigid board having greater length than width. The rigid board having a rear end with a high pressure water outlet nozzle and a central pipe connecting a water hose inlet, wherein the outlet nozzle when fed with a high pressure water source from the water hose inlet provides a forward thrust to the water propelled hover board.

16 Claims, 25 Drawing Sheets

FORWARD PROPELLED HOVER BOARD

This application is a non-provisional application which is a continuation of the co-pending U.S. patent application Ser. No. 14/066,997 filed Oct. 30, 2013 of common inventorship. This application also claims priority to U.S. Provisional application No. 61/720,791 filed Oct. 31, 2013 of common inventorship. The present invention relates to a sports amusement device comprising a board that supports a flyer standing on the board, wherein the board is lifted in the air by water powered nozzles fed by a high pressure water hose connected to a quick connect pivoting ball joint assembly on the bottom of the board.

FIELD OF INVENTION

Background of the Invention

Water powered personal propulsion devices date back to at least 1966. See U.S. Pat. No. 3,277,858 to Athey. Athey uses a floating internal combustion engine which powers a pump. A hose runs from the pump to a pair of hip mounted nozzles on a diver. The '858 patent only shows a diver being propelled through the water. However, a jet ski powering the '858 device shown in FIG. 1 has been demonstrated to fly a rider several feet above the water.

A personal propulsion device trademarked as the Flyboard™ uses a jet ski with a diverter hose to power two nozzles on a metal Y shaped pipe mounted to the bottom of a plastic board. The flyer mounts his boots to the top of the board. A companion on the jet ski can control the throttle to lift the flyer as high as forty feet above the water. Forearm mounted control nozzles are also powered from a portion of the high pressure water stream. The flyer can perform dolphin type maneuvers in and out of the water as well as back flips and spinning maneuvers. The Y shaped metal diverter has a pair of ball bearings that mount on the plastic board bottom. This allows the hose to remain vertical as the board tilts toes down or toes up in relation to a horizontal orientation. An optional throttle cable can be controlled by the flyer. It runs down the center of the hose. This is the closet known prior art.

Three U.S. patents describe a shoulder mounted pair of nozzles powered by a jet ski. They are U.S. Pat. Nos. 7,258,301, 7,735,772 and 7,900,867. This personal propulsion device mounts a pair of nozzles above the flyer's center of gravity. Lift and descent are controlled by a cross arm in front of the rider that controls the tilt angle of the pivotable nozzles. These nozzles are strapped at shoulder level to the rider's back.

What is needed in the art is a lightweight, plastic board assembly that floats. Quick disconnect boots and a quick disconnect hose are needed. Curtain nozzle patterns are needed to eliminate hand control nozzles. The present invention meets all these needs.

SUMMARY OF THE INVENTION

The main aspect of the present invention is to provide a snowboard type board with a built in pivotable nozzle on the bottom, wherein the nozzle receives high pressure water, nominally from a jet ski, and diverts this water to two thrust nozzles under the board.

Another aspect of the present invention is to provide a built in land platform for the board to allow the rider to stand with the hose resting on the land and stretched out from the board to the pump source.

Another aspect of the present invention is to provide a quick disconnect mount for the rider boots.

Another aspect of the present invention is to provide a curtain nozzle at each end of the board to help stabilize the board in flight.

Another aspect of the present invention is to provide a quick disconnect for the hose on the pivotable nozzle.

Another aspect of the present invention is to build the entire board assembly from light weight materials including injection molded plastic and flotation foam.

Another aspect of the present invention is to provide an electronic glove controller to control the throttle and emergency shut off on the jet ski.

Another aspect of the present invention is to provide a boot tilt option on the board to allow the nozzles to be independently tilted with their left and right board sections.

Another aspect of the present invention is to provide a two rider board.

Another aspect of the present invention is to provide a barefoot quick disconnect mount for the board.

Another aspect of the present invention is to provide a multi-purpose mounting flange for a jet ski to allow normal use and quickly change to a hose connection.

Another aspect of the present invention is to provide a rider hand grip under the board.

Another aspect of the present invention is to provide a launch stand for the board.

Another aspect of the present invention is to provide a quick boot disconnect assembly powered by the high pressure water.

This flying board may be powered by a land based pump at an arena at a pool. Already the jet ski powered board is gaining attention worldwide. Double back flips from forty feet in the air are being done on the prior art Flyboard™.

The present invention has a unibody construction with a Y shaped high pressure water diverter and a left and a right nozzle built in. Each nozzle has a diverter valve to adjust the flow to a secondary nozzle shaped like a C. This C shaped end nozzle, also called a curtain nozzle, provides platform stability, wherein beginners may divert most all of the water to the C shaped nozzle. Experts may execute their flips with full diversion to the main thrust nozzles.

Safety is improved with several versions of quick disconnect boots or a barefoot binding. A wireless glove mounted electronic trigger can divert the high pressure water to release the bindings.

In summary the present invention improves control with the C shaped nozzles, reduces costs and weight with a unibody design, and increases safety with less weight, elimination of hand nozzles, and a quick release boot system.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
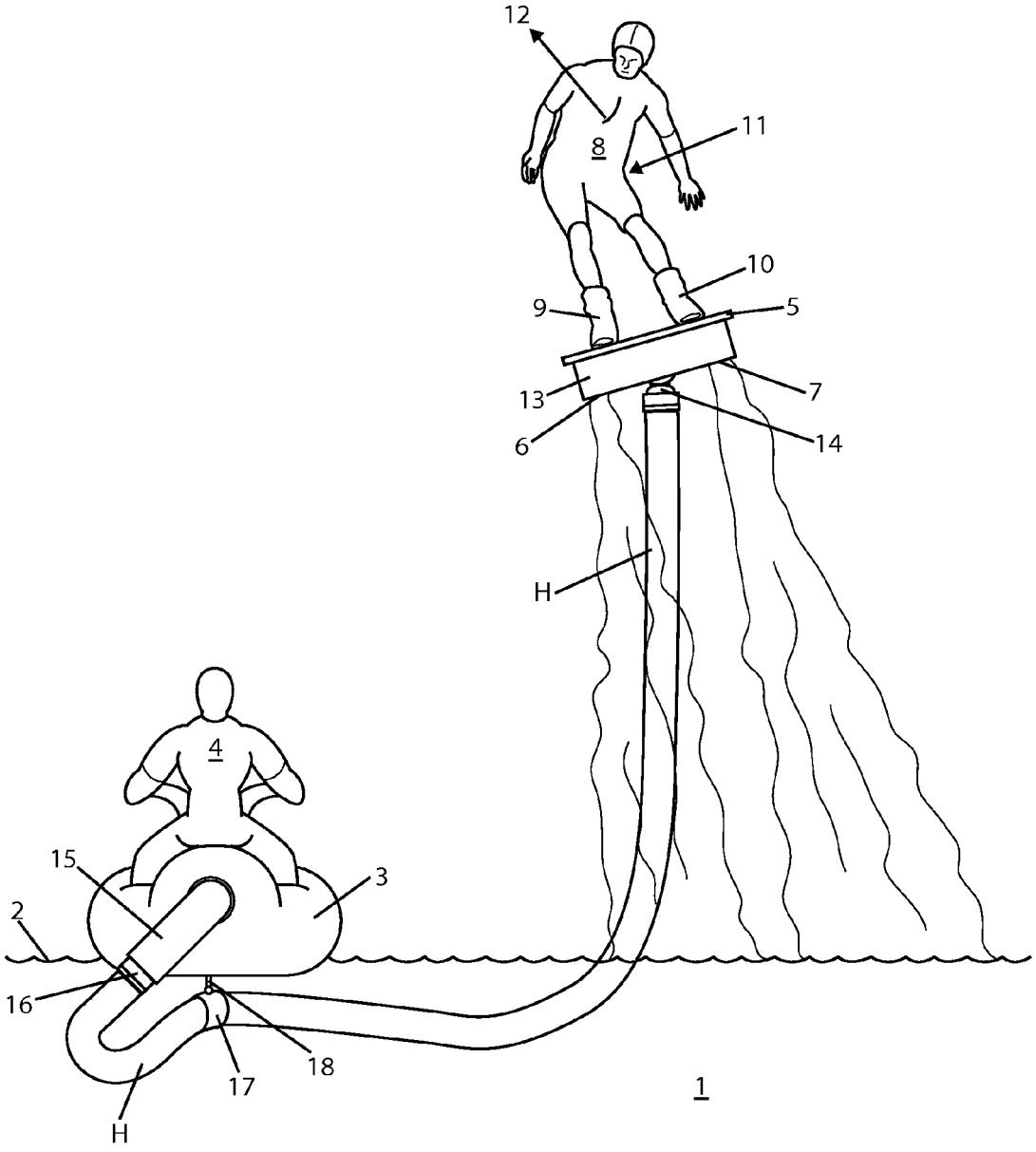
FIG. 1 is a perspective view of the flying board powered by a conventional jet ski.

Referring first to FIG. 1 a body of water 1 has a surface 2, wherein a standard jet ski 3 floats on the surface 2. A jet ski driver 4 controls the throttle of the jet ski which in turn controls the thrust from the flying board 5 thrust nozzles 6, 7. The rider 8 controls the flying board 5 using his feet which are mounted in boots 9, 10 for tilting toe down, toe up. He uses the side to side angulation of his body indicated by arrow 11, and he uses the forward/backward lean of his body indicated by arrow 12. It is with these combined movements that flying, diving and doing a dolphin type diving are accomplished.

The flyboard board 5 has a unibody construction 13 preferably from an injection molding process. At the center of the unibody housing 13 is an inlet port 14 which is both a quick disconnect joint and a swivel joint. As seen this swivel joint 14 allows the hose H to remain about vertical as the flying board 5 tilts. The jet ski 3 has had its thrust nozzle replaced with a diverter conduit 15. A quick connect coupling connects the hose H to the diverter conduit 15.

A flexible collar 17 (preferably made of rubber) helps prevent pinching of the hose H. The collar 17 has an attachment 18 to the jet ski 3.

Figure 2:
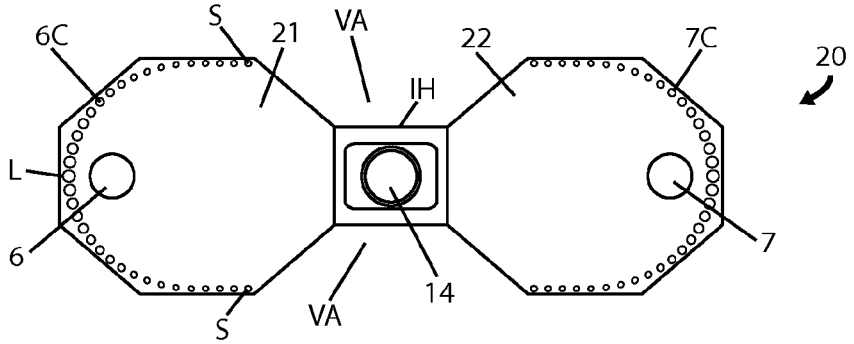
FIG. 2 is a bottom plan view of a shorter width board with one main thrust nozzle and curtain nozzles.
Figure 3:
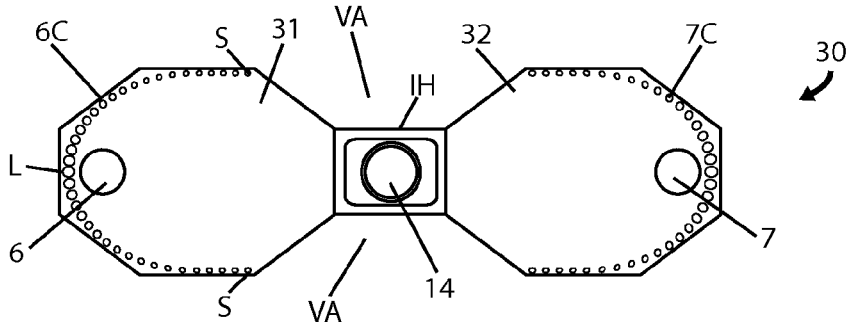
FIG. 3 is a bottom plan view of a middle width board with one main thrust nozzle and curtain nozzles.
Figure 4:
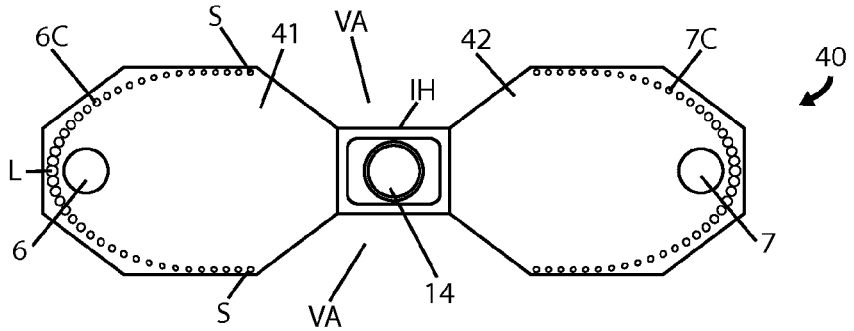
FIG. 4 is a bottom plan view of a wide width board with one main thrust nozzle and curtain nozzles.

Referring next to FIGS. 2, 3, 4 a flying board 20 has a shorter end to end footprint than the long flying board 40 shown in FIG. 4. The flying board 20 has a larger side to side width than the middle sized flying board 30 shown in FIG. 3. Otherwise all features of flying boards 20, 30, 40 are identical.

Opposing ends 21, 22 and 31, 32 and 41, 42 are shaped as octagons. Separating each set of opposing ends is an inlet housing IH. The inlet housing IH has a smaller width than the opposing ends so as to create a rider viewing area VA between the rider's feet. Thus, the rider can look down at the water as he flies above the water.

The thrust nozzles 6, 7 are powered with the high pressure water coming into inlet port 14. The curtain nozzles 6C, 7C assist the rider to balance the flying board. Before flying the rider manually sets the divergence of water between the thrust nozzles 6, 7 and curtain nozzles 6*c*, 7*c* in any range of split from 0 to 100%.

The curtain nozzles 6C, 7C form a separate thrust pattern in roughly a semi-circular pattern around the thrust nozzles 6, 7. Each hole may be the same size. One option is to enlarge the hole sizes from smallest S to largest L in the center to smallest S at the opposite end of the pattern.

Figure 5:
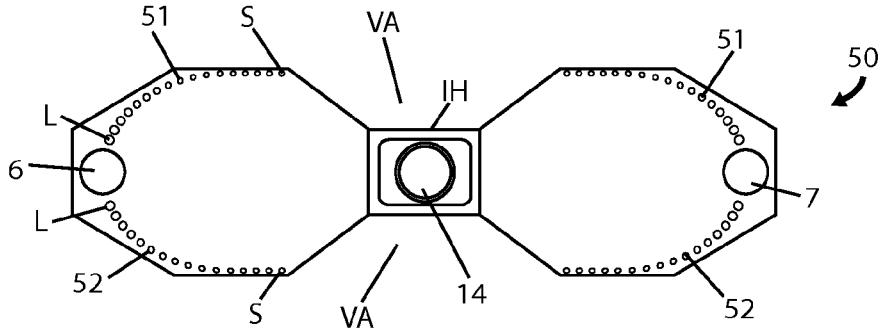
FIG. 5 is a bottom plan view of a board having the main thrust nozzle integrated with the curtain nozzle.

Referring next to FIG. 5 a flying board 50 has the curtain nozzles pattern 51, 52 interrupted by the thrust nozzles 6, 7. Once again the hole sizes could be all the same or get larger from a smallest S to a largest L at the end position.

Figure 6:
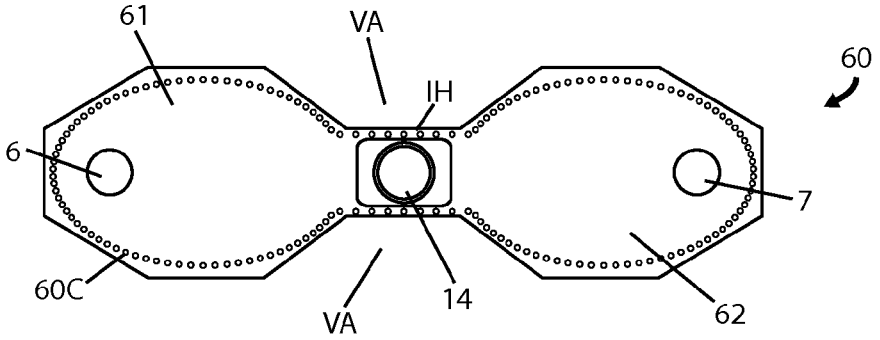
FIG. 6 is a bottom plan view of a board with curtain nozzles extending all around the board.

Referring next to FIG. 6 a flying board 60 has a pattern of curtain nozzles 60C that totally encircle the periphery of the flying board 60. They pass around opposing ends 61, 62 and the inlet housing IH.

Figure 7:
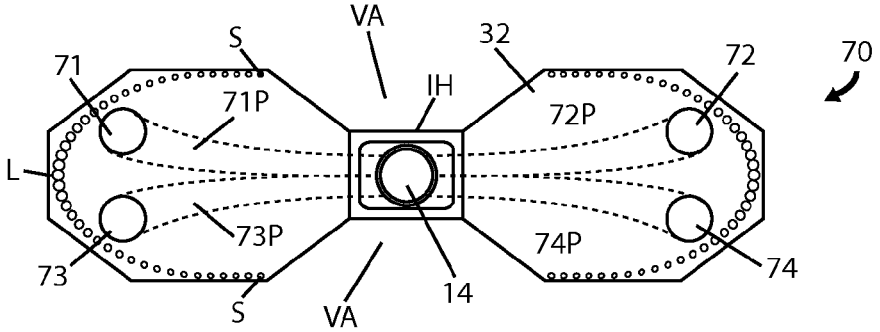
FIG. 7 is a bottom plan view of a board having four main thrust nozzles and curtain nozzles.

Referring next to FIG. 7 a one rider flying board to has two sets of nozzles, 71, 72, 73, 74 which are fed by respective feeder pipes 71P, 72P, 73P, 74P. Fire departments could use high power four nozzle systems to lift a fireman and his own hose.

Figure 8:
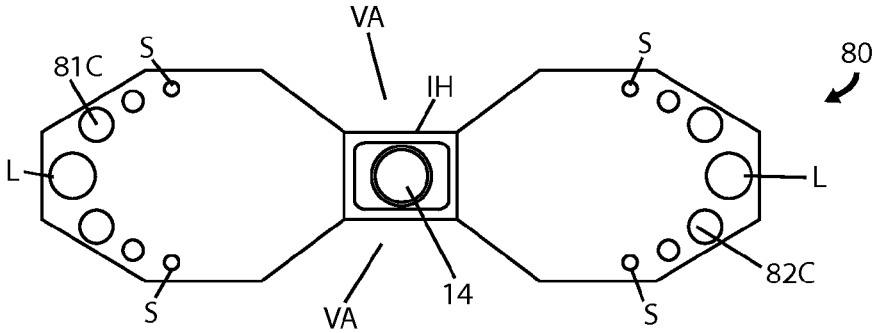
FIG. 8 is a bottom plan view of a board with enlarged curtain nozzles and no main thrust nozzles.

Referring next to FIG. 8 a flying board 80 does not have thrust nozzles at all. Instead the curtain nozzles 81C and 82C are oversized.

Figure 9:
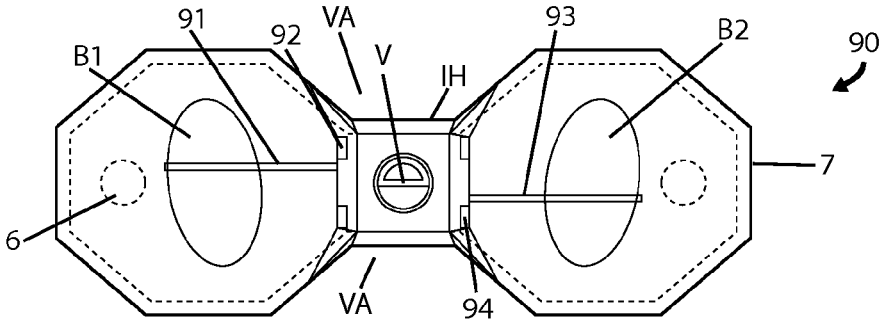
FIG. 9 is a top plan view of a board with two main thrust nozzles and a central flow valve.

In FIG. 9 a flying board 90 shown in a top plan view has no curtain nozzles. A control valve v can limit the flow to thrust nozzles 6, 7. Boot mounting pods B1, B2 have a quick release feature 91, 93 which is activated by buttons 92, 94.

Figure 10:
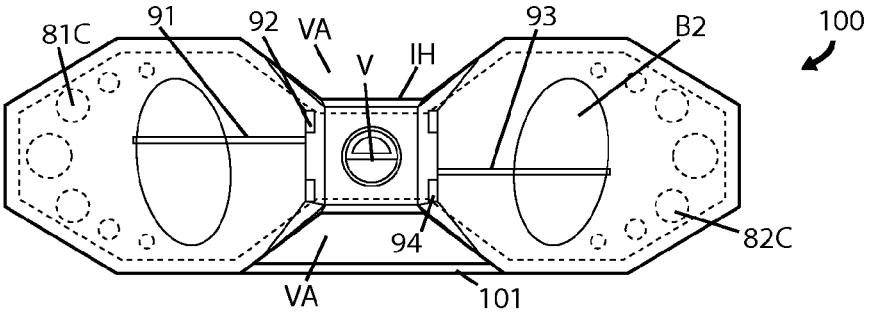
FIG. 10 is a top plan view of a board with only enlarged curtain nozzles and a hand grasp bar.

In FIG. 10 a flying board 100 has the curtain nozzle pattern shown in FIG. 8. A rider hand grasp bar 101 is used by experienced riders for acrobatic maneuvers.

Figure 11:
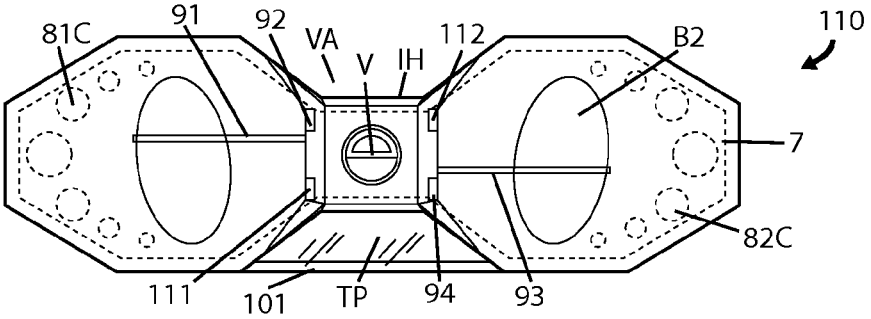
FIG. 11 is top plan view of a board as shown in FIG. 10 with a transparent window.

In FIG. 11 a flying board 110 has a transparent panel TP attached to the hand grasp bar 101. Additional flow control valves 111, 112 can provide the rider additional tuning of his thrust.

Figure 12:
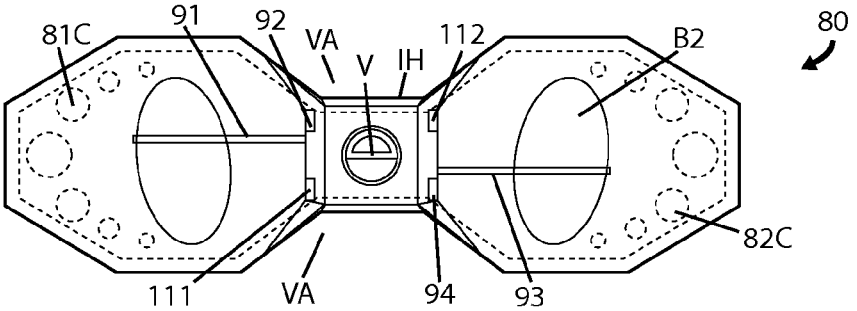
FIG. 12 is a top plan view of the board shown in FIG. 8.

In FIG. 12 the flying board 80 is shown in a top plan view.

Figure 13:
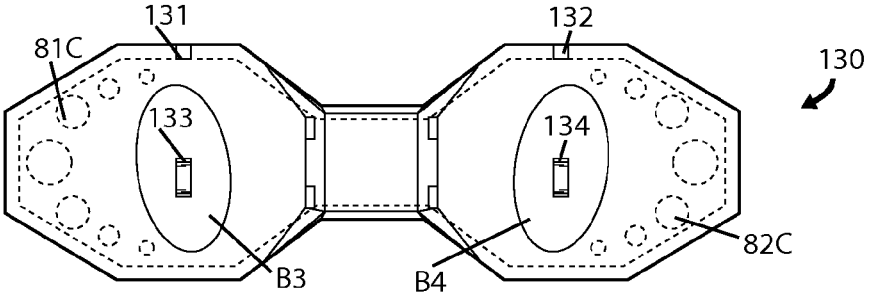
FIG. 13 is a tip plan view of a board with no central flow valve and quick disconnect boots.

In FIG. 13 the flying board 130 uses a center boot latch 133, 134 for boot mounting pods 3, B3, B4. A button 131, 132 is depressed to release the respective latch 133, 134. U.S. Pat. Nos. 7,104,564, 6,769,711 and 6,659,494 are incorporated herein by reference to provide quick dismount boot options. Water pressure could be used as a stored energy source to release the boots.

Figure 14:
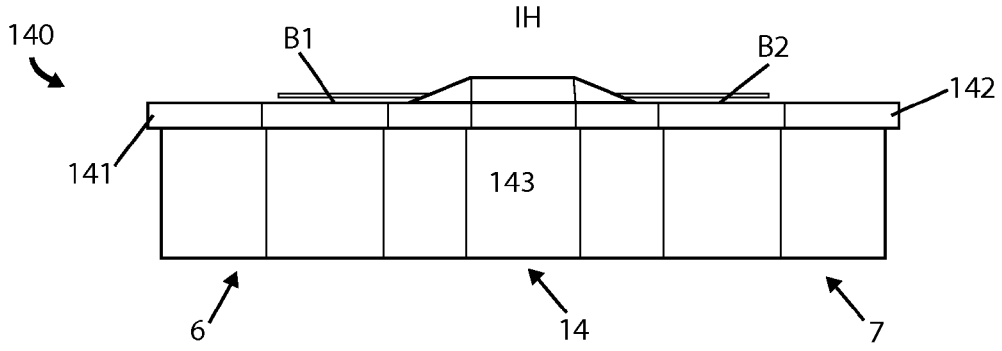
FIG. 14 is a front elevation view of a one piece flying board.

Referring next to FIG. 14 a flying board 140 has a wrap around vertical wall 143 supporting the opposite ends 141, 142 and the inlet housing IH. On land the wall 143 would rest on an unfilled hose (not shown) during the staging process.

Figure 15:
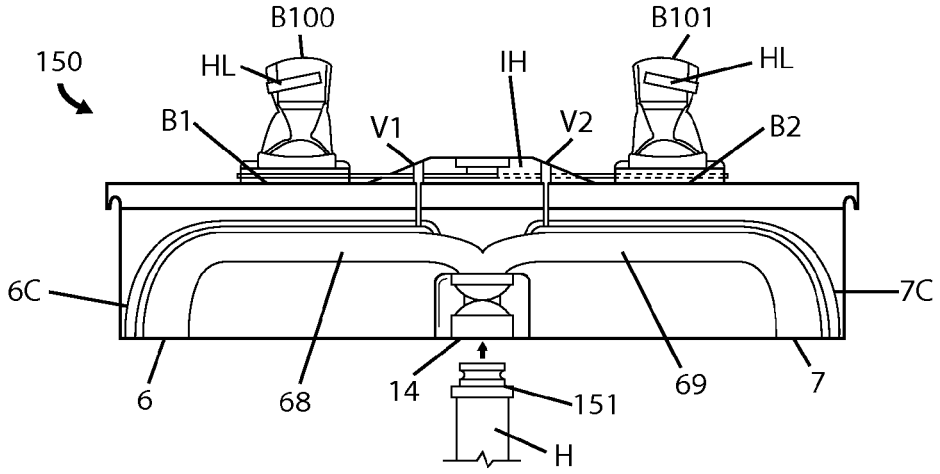
FIG. 15 is a rear cutaway view of a board similar to that shown in FIG. 14.

Referring next to FIG. 15 a flying board 150 uses the thrust nozzles 6, 7 as support columns when staging on land. The inlet port 14 is slightly recessed to allow an empty hose to extend outward from the flying board 150 on land. A quick disconnect fitting 151 snaps into inlet port 14. The boots B100 and B101 have a hook and loop ankle release HL. Valves V1, V2 provide adjustment for flow diversion from the thrust nozzles pipes 68, 69 to the curtain nozzles 6C, 7C.

Figure 16:
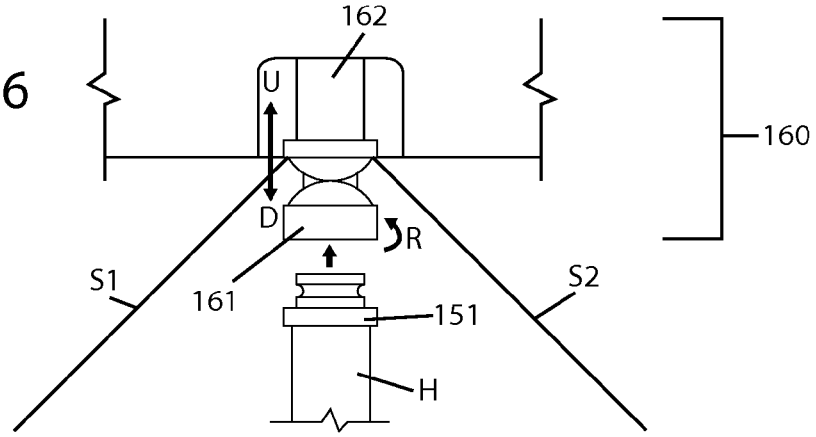
FIG. 16 is a rear elevation view of the quick disconnect hose.

Referring next to FIG. 16 a telescoping inlet nozzle 160 has a sliding fixture 161 moving up and down on a fixed pipe 162. The concept is to connect the quick disconnect fitting 151 while the sliding fixture 161 is up shown by arrow U. Then when water pressure builds in hose H, the sliding fixture 161 pops out shown by arrow D. Then the swivel feature of inlet nozzle 160 allows a conical pattern of hose H movement shown between lines S1, S2. The sliding fixture 161 also rotates 360° as shown by arrow R. This swivel feature is shown in FIG. 1, wherein the rider does not have to fight the weight of a water filled hose H being lifted horizontally.

Figure 17:
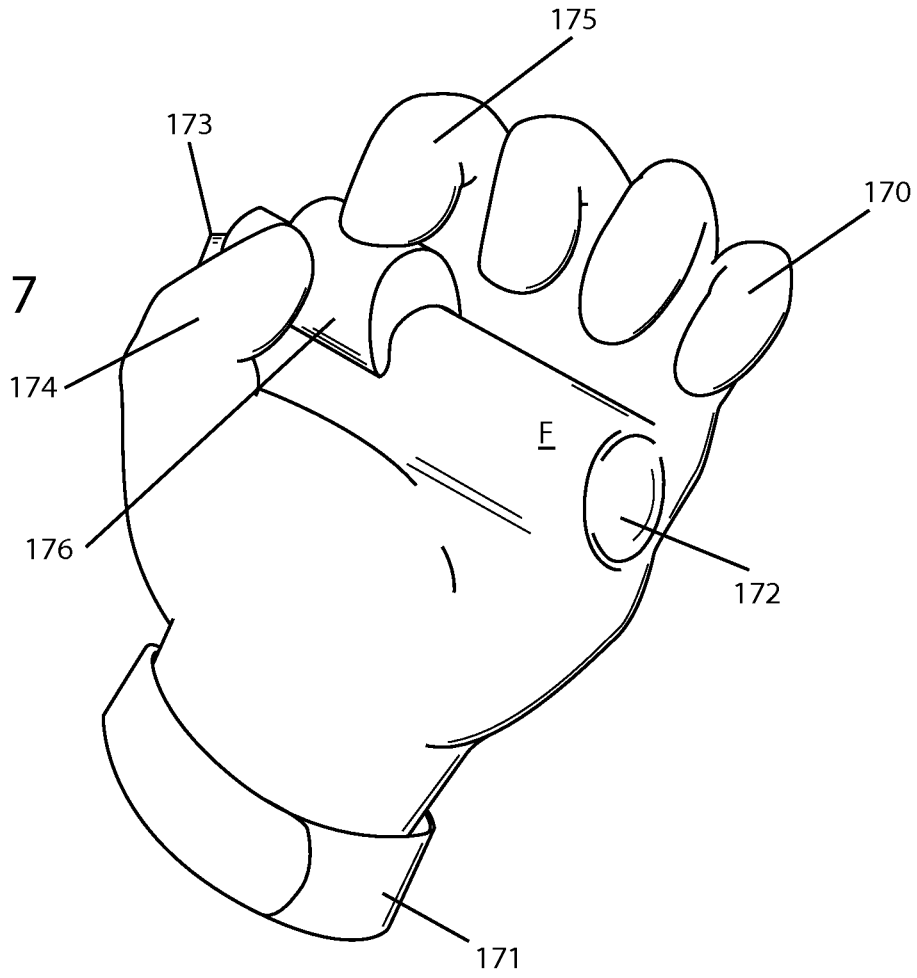
FIG. 17 is a front perspective view of the glove mounted controller.

Referring next to FIG. 17 a control glove 170 has a wrist strap 171 containing a battery and a wireless transmitter and a control circuit. A cylindrical rail 172 has a kill switch 173 for the thumb 174. The forefinger 175 moves the throttle bar 176 from idle as shown to wide open at F. This control glove 170 is used when a rider-less jet ski is equipped with a wireless controller for throttle and kill switch.

Figure 18:
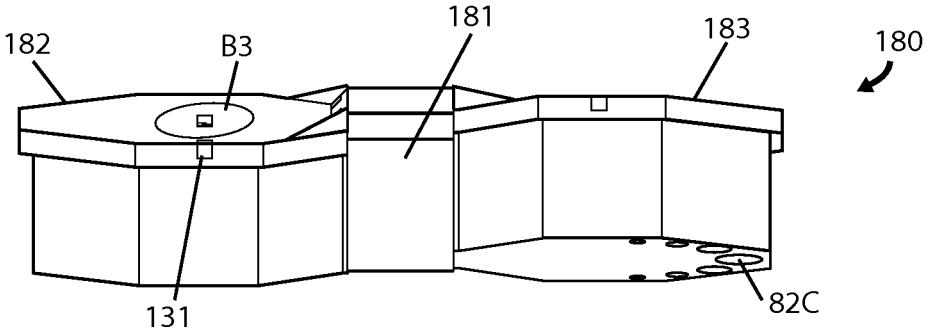
FIG. 18 is a front elevation view of a tilt board embodiment.
Figure 19:
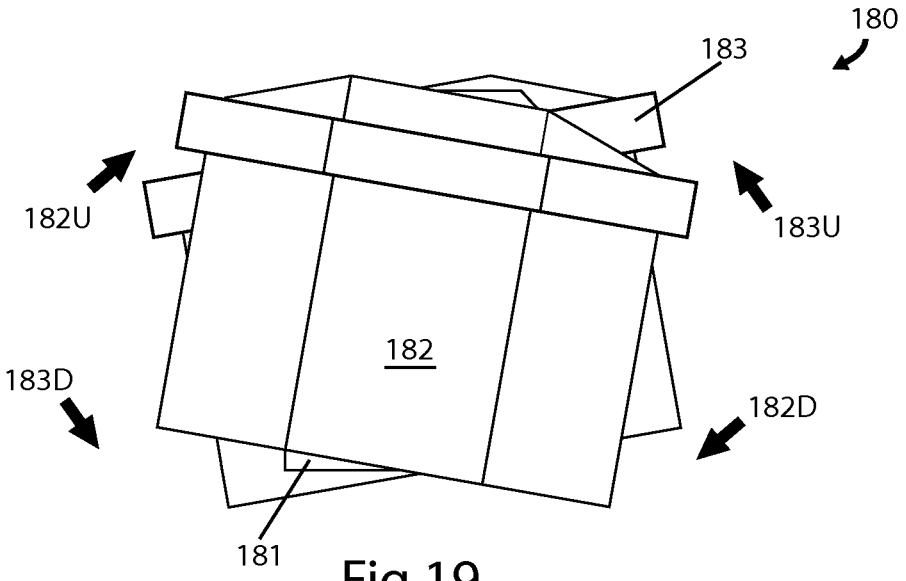
FIG. 19 is an end elevation view of the embodiment shown in FIG. 18.

Referring next to FIGS. 18, 19 a trick flying board 180 has a central inlet housing 181. A left foot platform 182 swivels independently from a right foot platform 183, arrows 182U and 182D show the left foot platform moving in relation to right foot platform arrows 183U, 183D.

Figure 20:
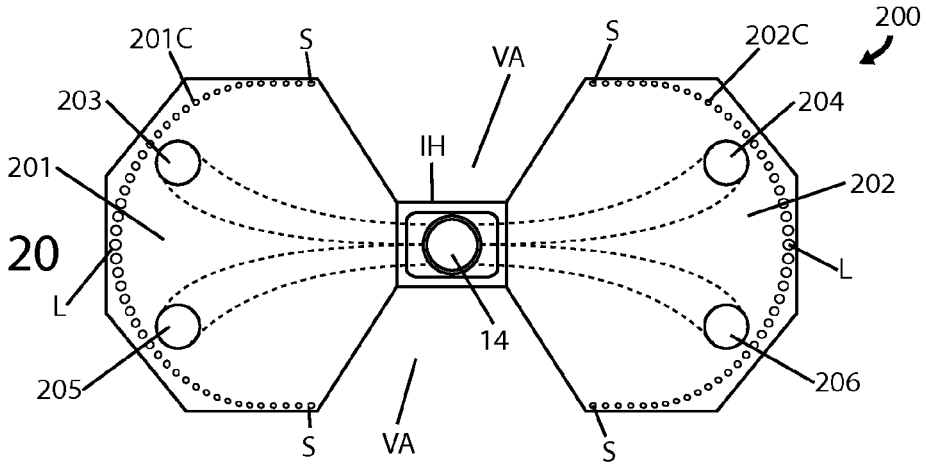
FIG. 20 is a bottom plan view of a two rider board.
Figure 21:
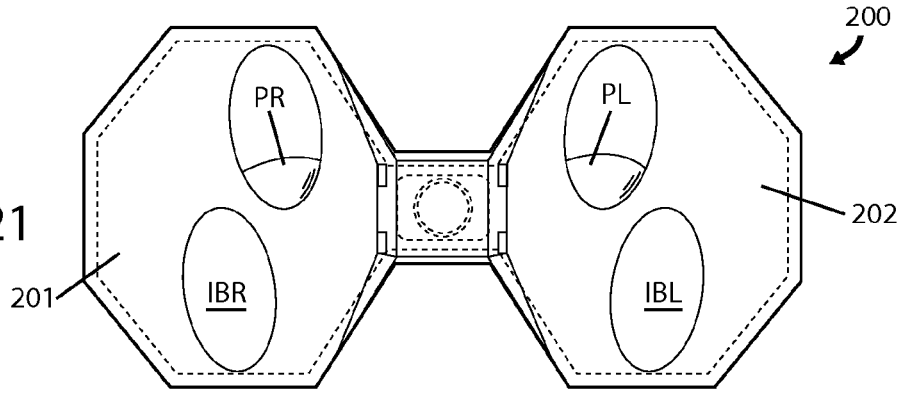
FIG. 21 is a top plan view of the embodiment shown in FIG. 20.
Figure 22:
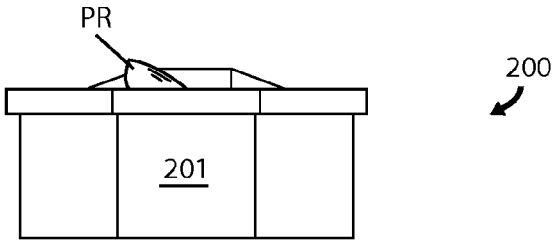
FIG. 22 is an end elevation view of a two rider board with rear slip in foot compartments.

Referring next to FIGS. 20, 21, 22 a two rider flying board 200 is shown. Left platform 202 has thrust nozzles 204, 206 and curtain nozzles 202C. Right platform 201 has thrust nozzles 203, 205 and curtain nozzles 201C.

The instructor has instructor boot left pod IBL and instructor boot right pod IBR. The passenger holds onto the instructor and places his feet into passenger binding left PL and passenger binding right PR. This device could be used at fairgrounds, water parks and amusement parks to give people a real flying experience with no training.

Figure 23:
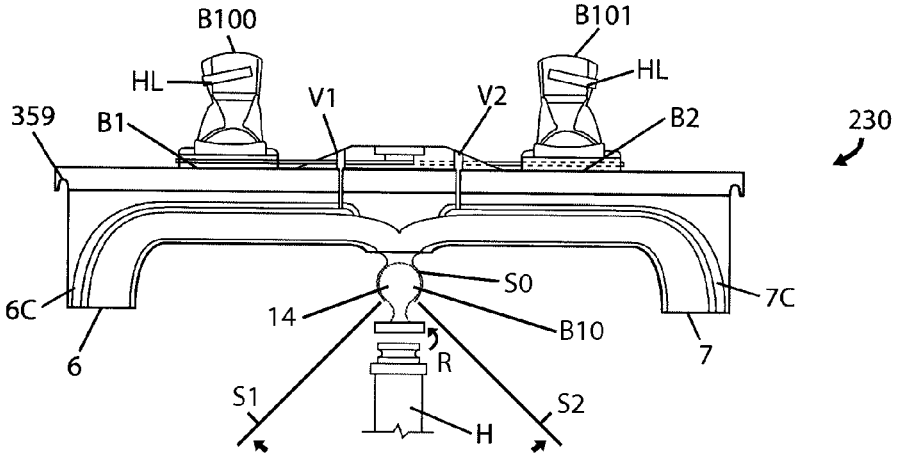
FIG. 23 is a cutaway view of another embodiment of a single rider board.

Referring next to FIG. 23, a flying board 230 is rectangular in shape. The inlet port 14 has a swivel design (as in a ball B10 and socket S10) to let the hose H move in the conical area between S1, S2. It also rotates per arrow R. The thrust nozzles 6, 7 provide support columns on land.

Figure 24:
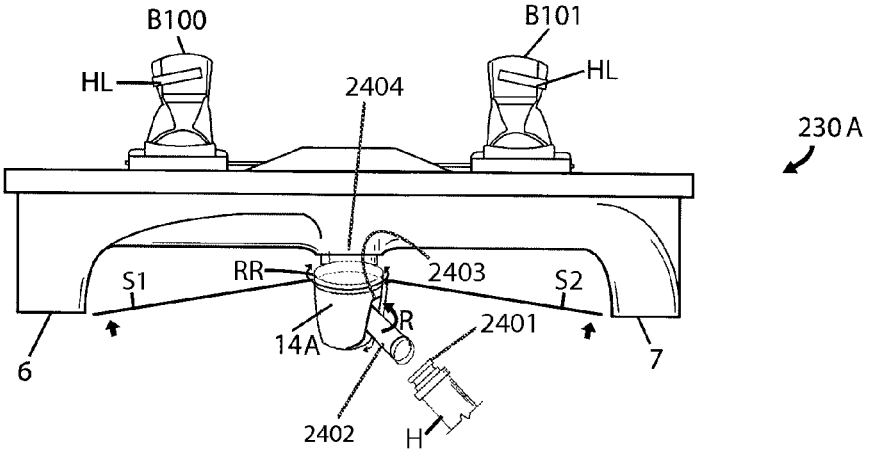
FIG. 24 is a rear elevation view of the embodiment shown in FIG. 23.

In FIG. 24 a flying board 230A shows the hose H having a quick connect fitting 2401 to a receiving pipe 2402. Receiving pipe 2402 can swivel up and down in the inlet housing 14A as shown by arrow R. The inlet housing 14A has a slot 2403 in which the receiving pipe 2402 swivels up and down thru a 90° arc. The inlet housing 14A rotates 360° in a base socket 2404 as shown by arrows RR. Thus, the hose H can move in the conical area S1, S2.

Figure 25:
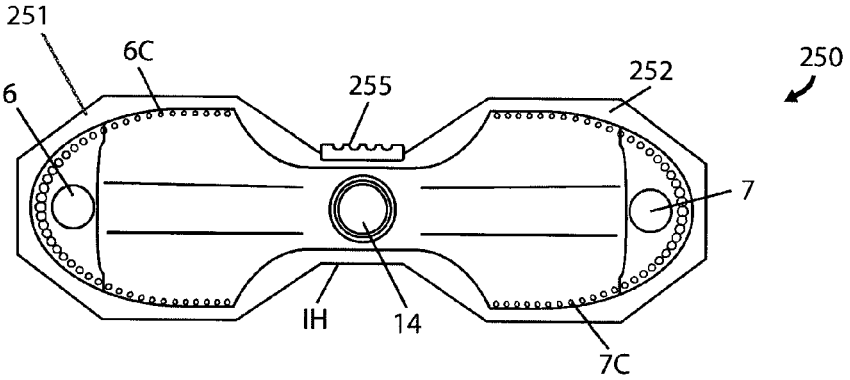
FIG. 25 is a bottom plan view of a hand hold embodiment.

In FIG. 25 a flying board 250 has opposing ends 251, 252. A front hand grip 255 is designed into the inlet housing IH.

Figure 26:
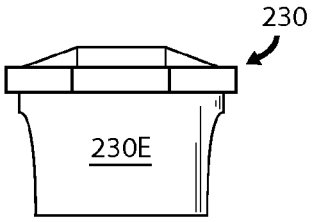
FIG. 26 is an end elevation view of the embodiment shown in FIG. 23.
Figure 27:
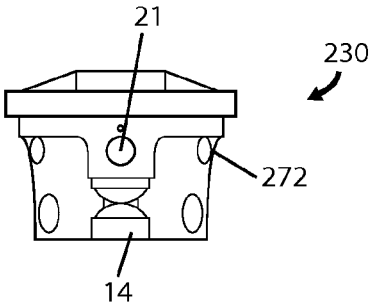
FIG. 27 is a sectional elevation view of the embodiment shown in FIG. 23 representing the nozzle configuration shown in FIG. 28.
Figure 28:
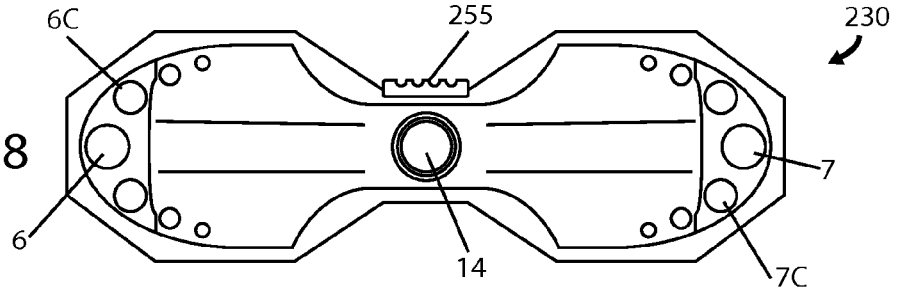
FIG. 28 is a bottom plan view of the embodiment shown in FIG. 23.

Referring next to FIGS. 26, 27, 28 the flying board of FIG. 23 is shown in further views. Each end 230E is a wall as seen in FIG. 26. FIG. 27 shows the thrust nozzles built in pipe 270 and curtain nozzles 272.

Figure 29:
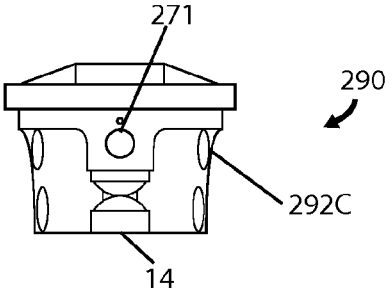
FIG. 29 is a sectional elevation view of the embodiment shown in FIG. 23 representing the nozzle configuration shown in FIG. 30.
Figure 30:
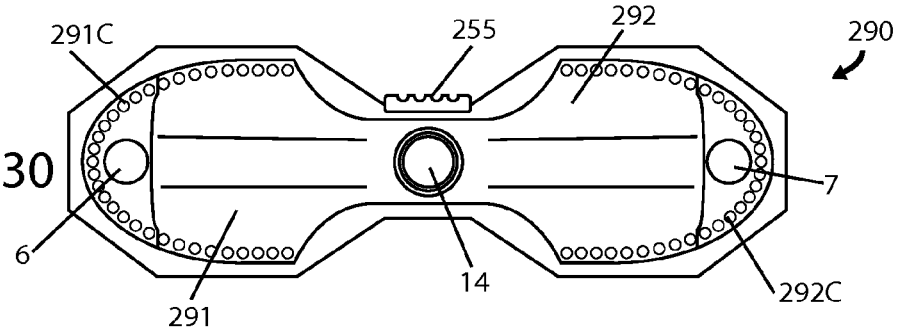
FIG. 30 is bottom plan another view of the embodiment shown in FIG. 23.

Referring next to FIGS. 29, 30 a flying board 290 looks like flying board 230 but has a peripheral curtain wall 291C, 292C for each end 291, 292.

Figure 31:
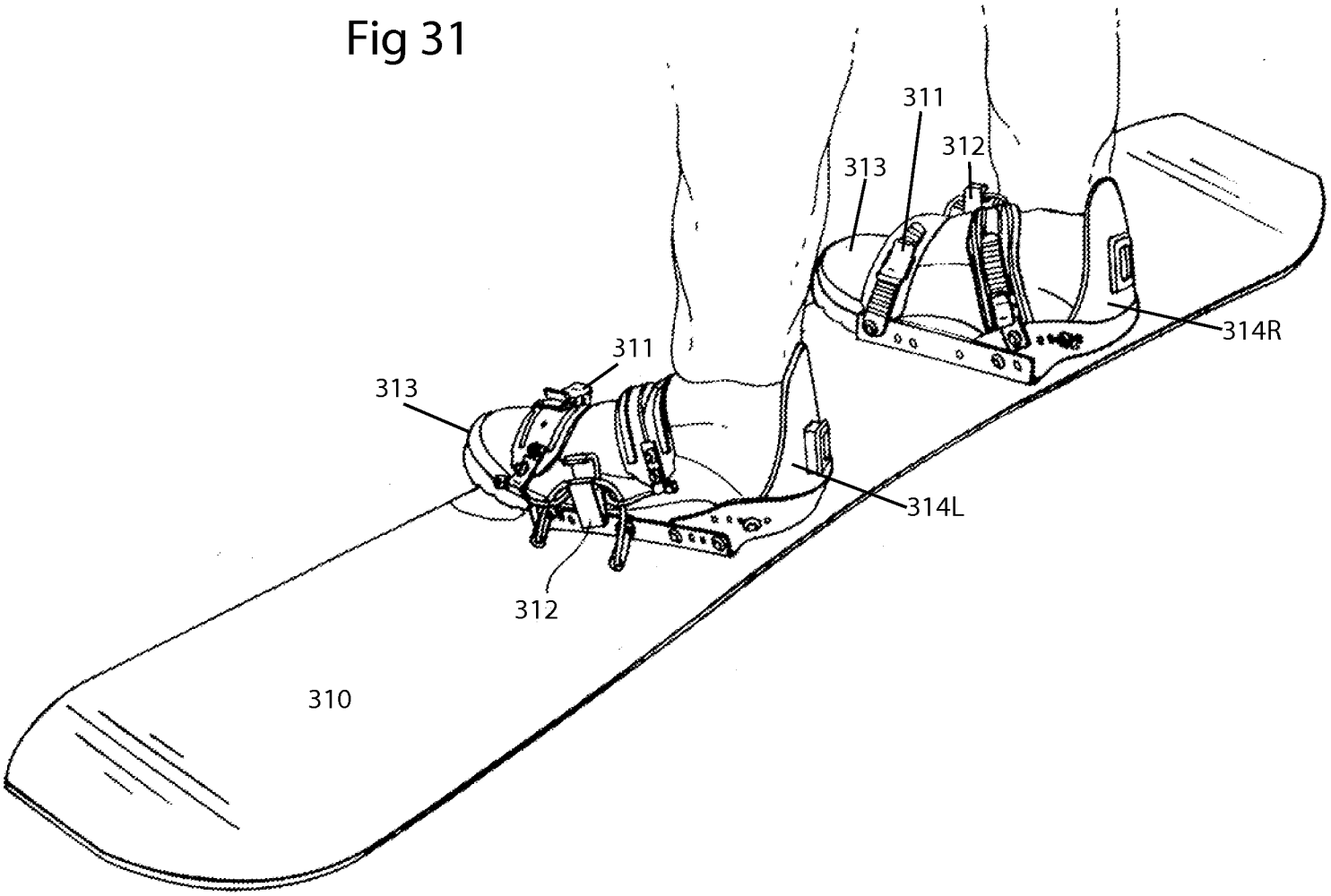
FIG. 31 is a rear perspective view of a barefoot binding embodiment.

In FIG. 31 a rider wears rubber booties 313. The heel supports 314L, 314R prevent backward movement on the flying board 310. The lower parts of the flying board are not shown. A simple toe strap assembly 311 holds the toes down. An upper arch strap assembly 312 holds the foot against the heel supports 314L, 314R. This is essentially a barefoot embodiment with the booties merely protecting skin abrasion. The rider can be completely barefoot when the straps are cushioned to protect the feet.

Figure 32:
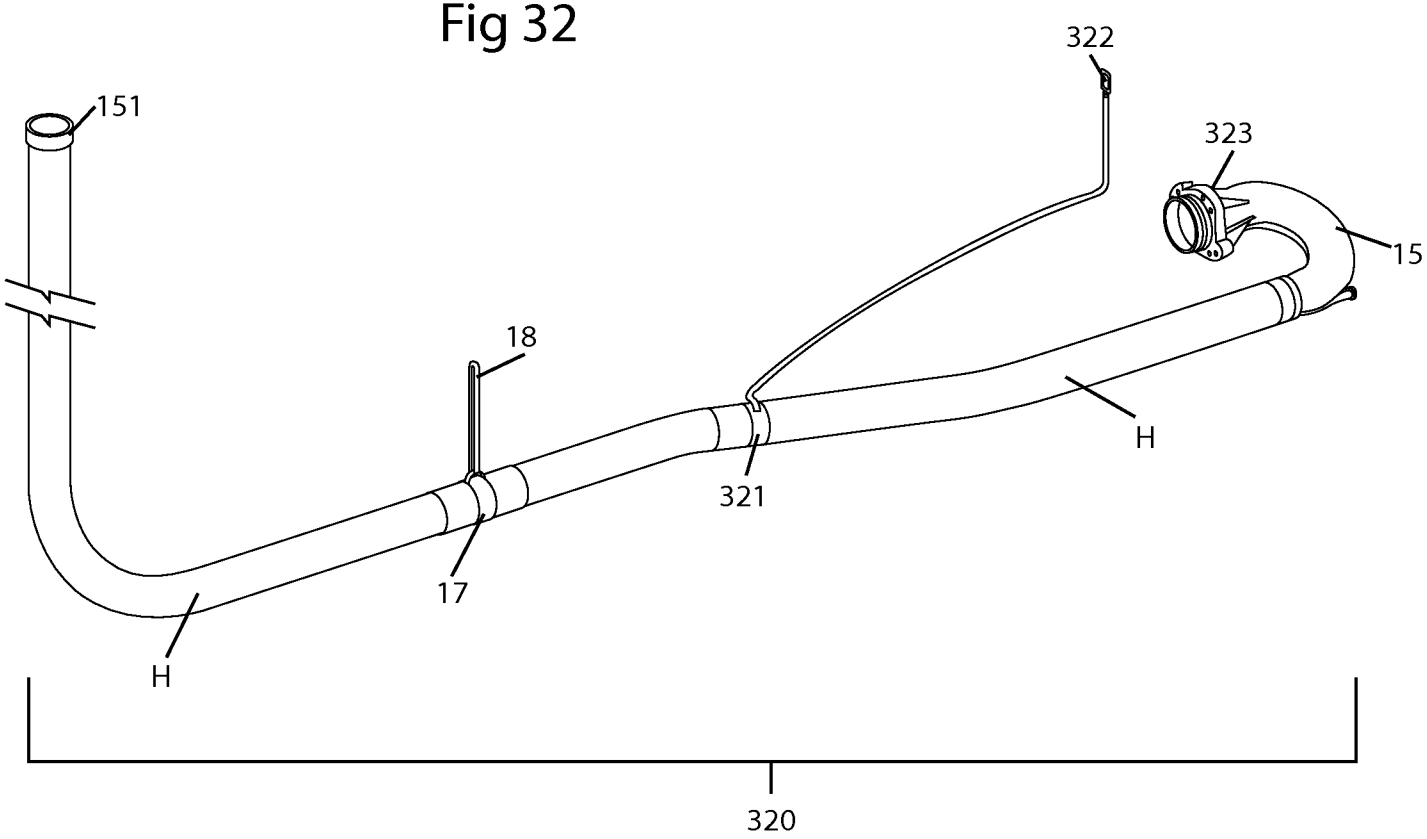
FIG. 32 is a perspective view of the entire hose assembly including quick connects and hose safety and control attachment.
Figure 33:
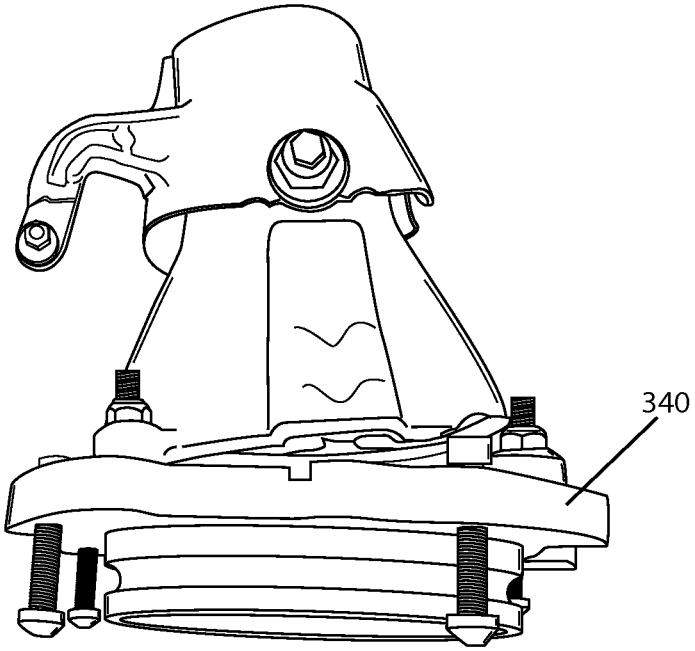
FIG. 33 is a side perspective view of a jet ski nozzle adapter.
Figure 34:
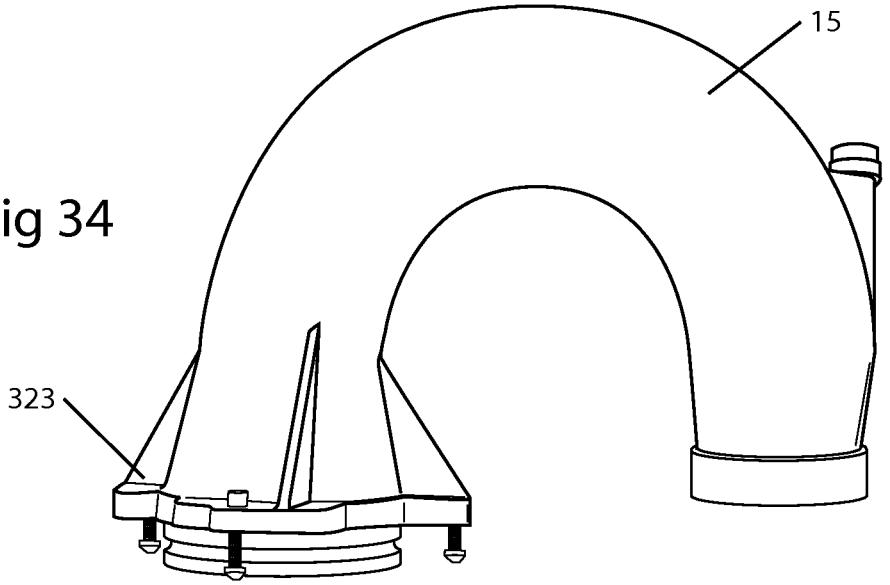
FIG. 34 is a side elevation view of a jet ski diverter coupling.

Referring next to FIGS. 32, 33, 34 the jet ski attachment assembly 320 is shown. First the jet ski rear thrust nozzles is removed. Then a universal adapter 340 is installed on the jet ski. This enables the diverter conduit 15 to be installed. The universal adapter also allows the original jet ski nozzles to be quickly reinstalled on the universal adapter 340. The hose H has an anchor collar 321 that secures a rear tether 322 for attachment to the jet ski.

The hose H has a rubber anti-crimp collar 17 that affixes to the front of the jet ski with tether 18. This tether 18 pulls the jet ski along if the rider controls his flying board to do so.

Figure 35:
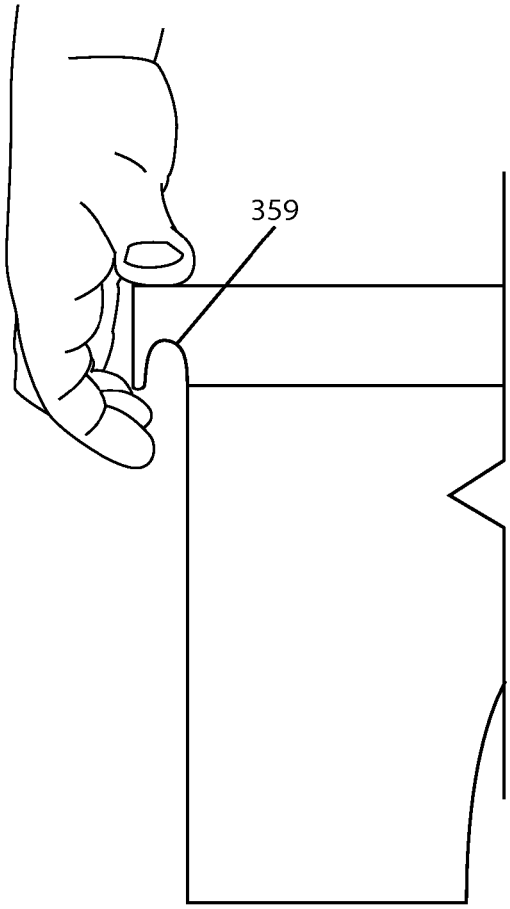
FIG. 35 is a close up view of a board hand hold.

In FIG. 35 an end hand grasp 359 is built into the flying board as shown in FIG. 23.

Figure 36:
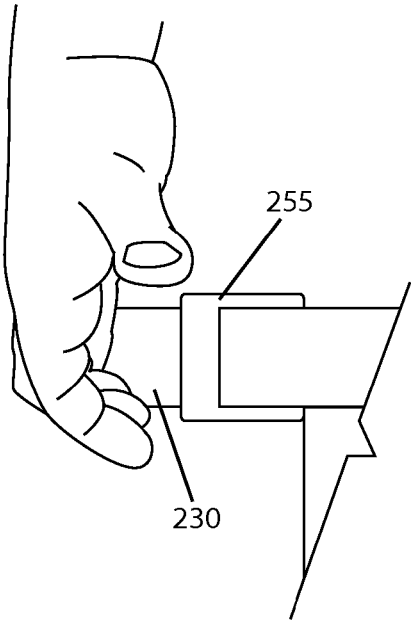
FIG. 36 is a close up view of the centrally located cushioned hand hold shown in FIG. 28 and FIG. 29

In FIG. 36 a front of inlet housing hand grasp 255 is shown as in FIG. 28.

Figure 37:
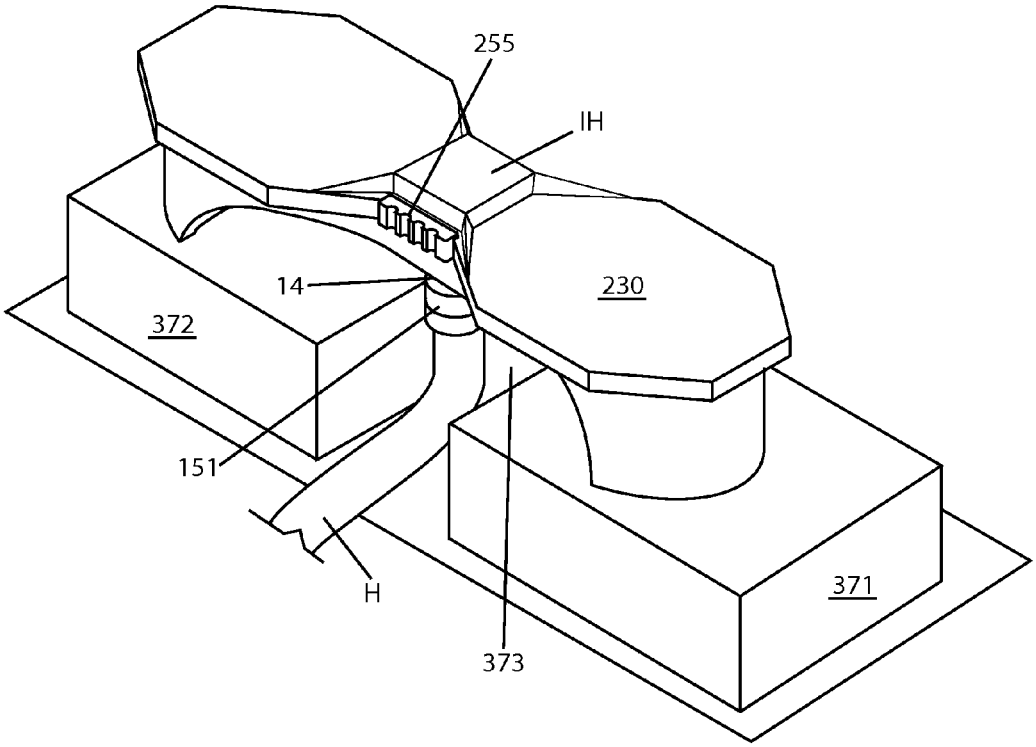
FIG. 37 is a top perspective view of a launch stand.

In FIG. 37 a stand 370 has pair of blocks 371, 372 with a separation area 373. This allows the hose H to be pressurized and lift the rider right off a land base.

Referring next to FIGS. 38-42 a dual side to side nozzle board 3800 is shown. The board has a rear hose inlet port 3802 shown with a quick connect collar 3803 of hose H inserted therein. A swivel joint 3804 allows the hose H to move in a cone pattern. A rotatable bearing 3805 allows the hose to orient 360° relative to the board 3801.

Boot mounts B1, B2 allows either a left or right foot forward orientation as exists for snowboarders. Side thrust nozzles 3806, 3807 are the primary lift nozzles, a curtain nozzle pattern for control is formed by peripheral nozzles 3808. Optional central forward nozzle 3809 and rear nozzle 3810 feed from internal built in pipe 3811. The curtain nozzles 3808 are powered by built in pipes C3808. All piping is built into the board 3801 preferably in a one piece injection molded housing.

Figure 54:
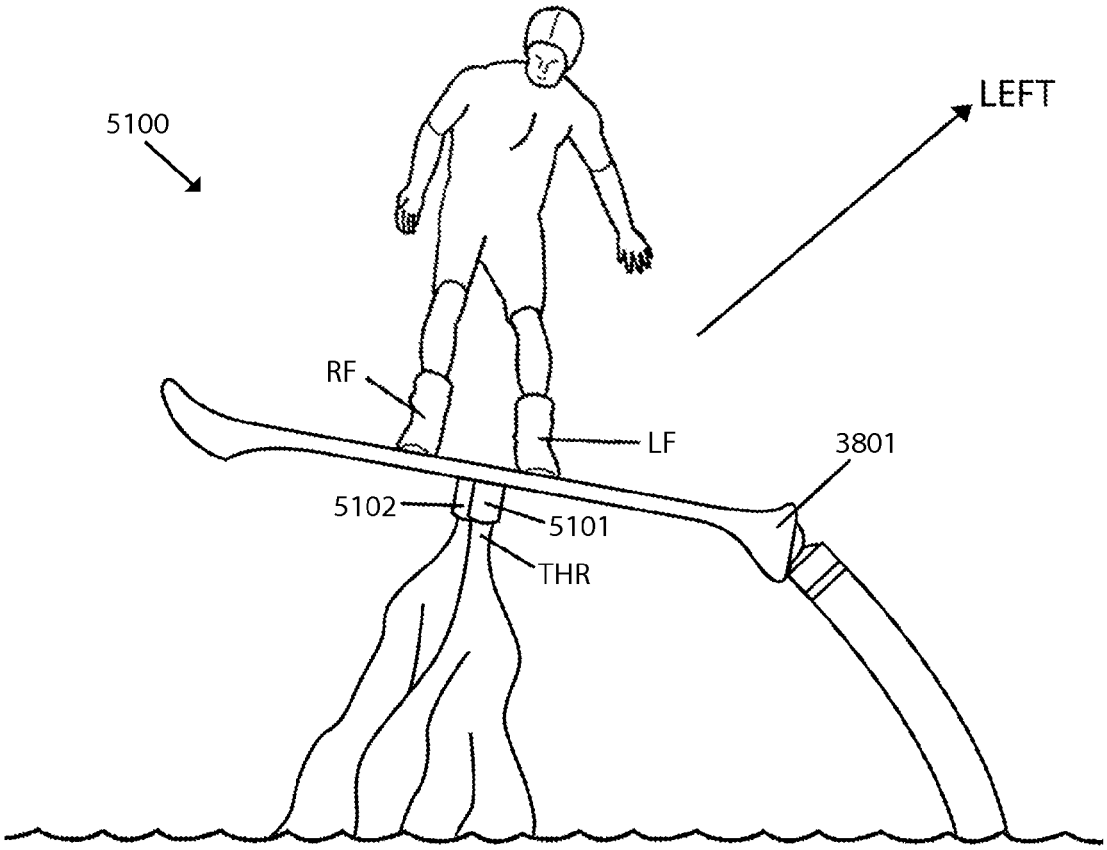
FIG. 54 is a side perspective view of a side to side nozzle steering vector right.
Figure 55:
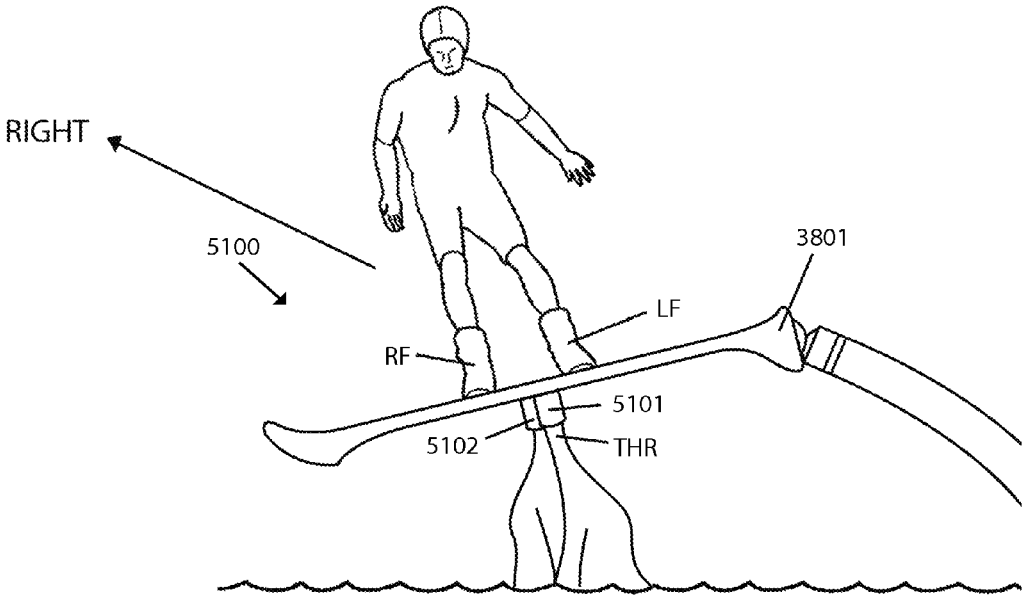
FIG. 55 is a side perspective view of a side to side nozzle steering vector left.

Controlling this board 3800 is shown in FIGS. 54, 55. The rider R is facing into the paper with the back of his head facing the reader. Just like in snowboarding the rider in FIG. 55 weights his right foot RF and turns to his right shown by arrow RIGHT because the thrust THR is being moved under him to his left.

FIG. 54 shows the opposite turn control with the rider R weighting his left foot LF and turning left shown by arrow LEFT. In this orientation he will drag the jet ski (not shown) along with him.

Figure 40:
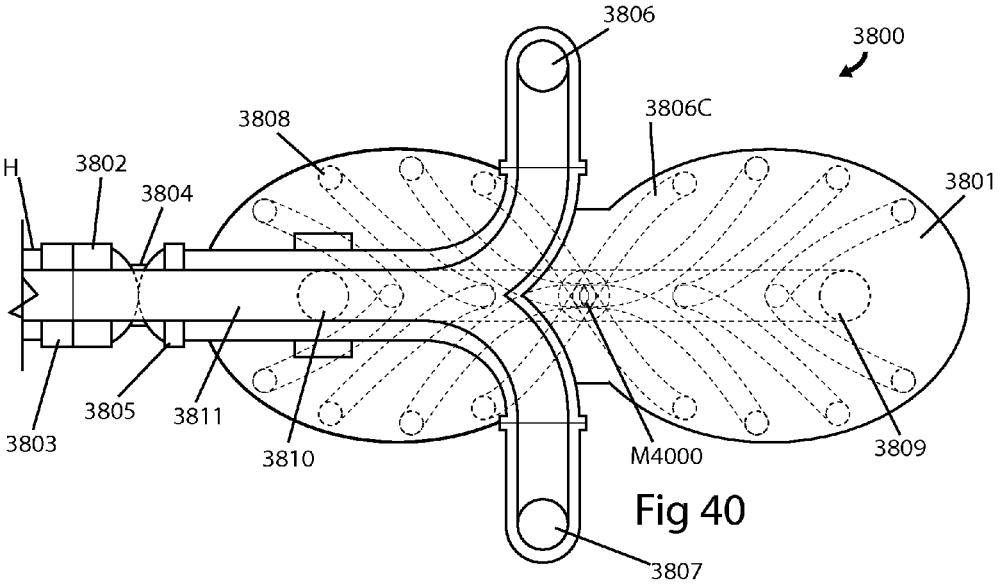
FIG. 40 is a cross sectional view of the FIG. 39 embodiment.
Figure 41:
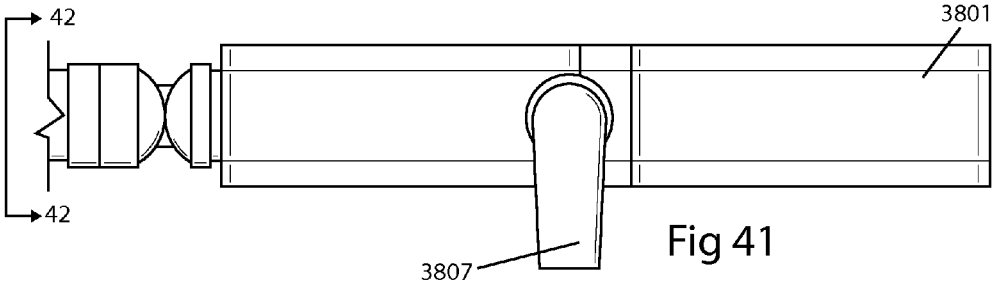
FIG. 41 is a left side elevation view of the FIG. 38 embodiment.
Figure 42:
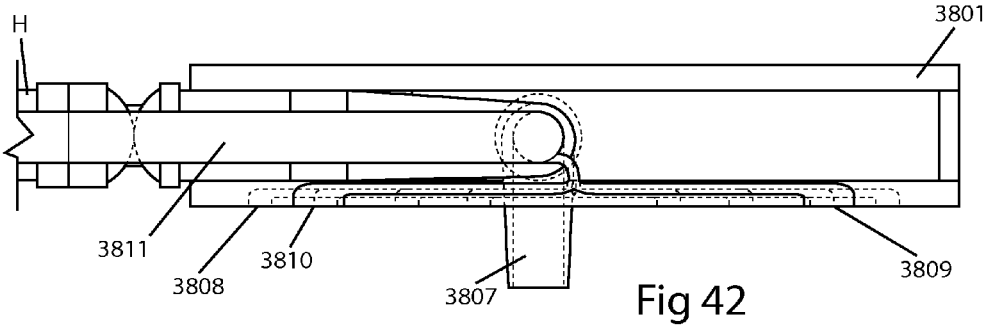
FIG. 42 is a cross sectional view taken along line 42-42 of FIG. 41.
Figure 43:
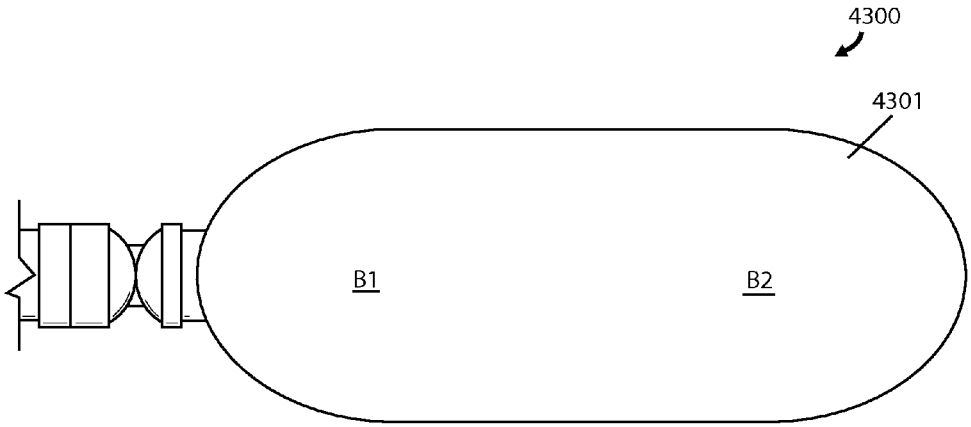
FIG. 43 is a top plan view of another embodiment having front and rear thrust nozzles.
Figure 44:
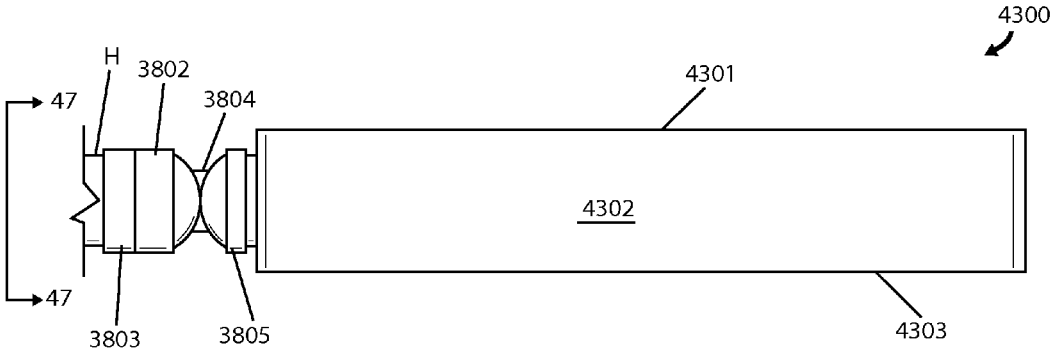
FIG. 44 is a left side elevation view of the FIG. 43 embodiment.
Figure 45:
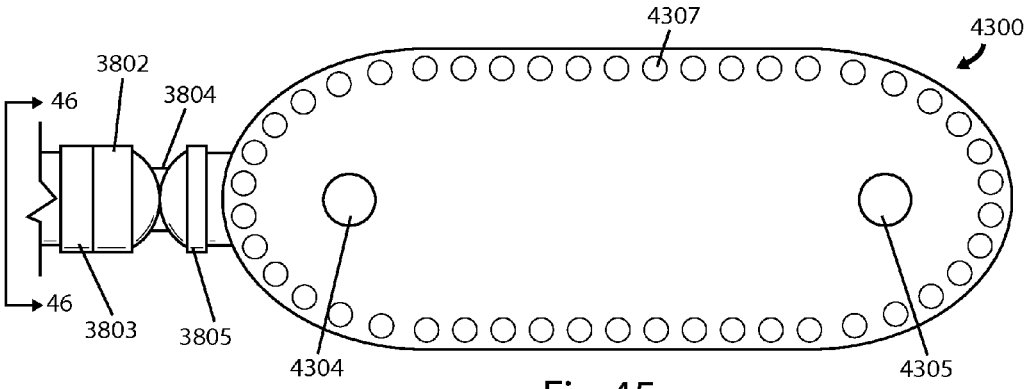
FIG. 45 is a bottom plan view of the FIG. 43 embodiment.
Figure 46:
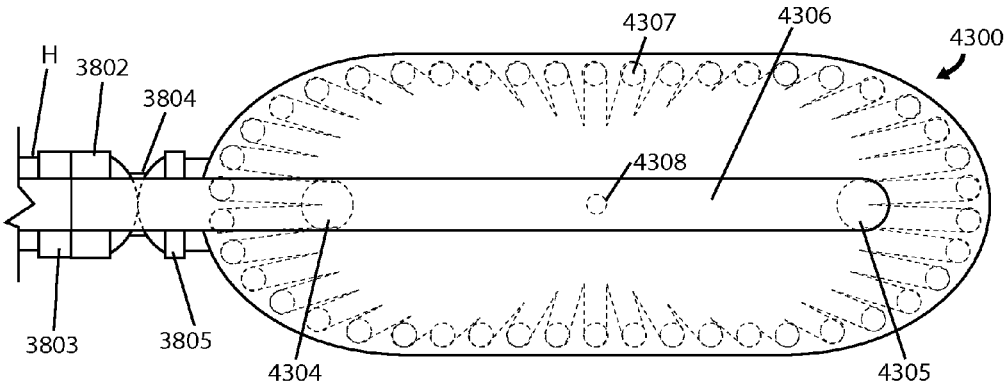
FIG. 46 is a cross sectional view taken along line 46-46 of FIG. 45.
Figure 47:
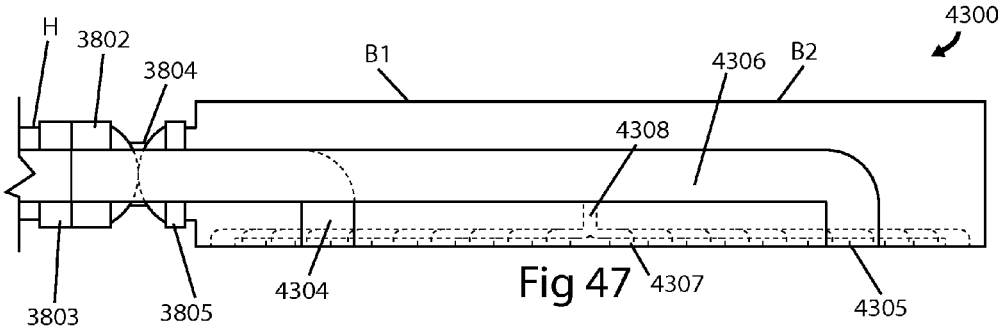
FIG. 47 is a cross sectional view taken along line 47-47 of FIG. 44.

In FIG. 40 an optional microcontroller M4000 is battery powered. A gyroscope is built into the microcontroller M4000. Control valves (not shown) are controlled by the microcontroller M4000 to divert water from side to side in curtain nozzles 3808 to maintain a level board 3801 and from nozzles 3809 and 3810 to maintain a level board 3801. This advanced self balancing system can help rental shops to quickly train new riders.

Referring next to FIGS. 43-47 a front to rear board 4300 is shown. Boot mounting pods B1, B2 are on the board top 4301. The bottom 4303 of the one piece housing 4302 is flat, making staging on land easier.

The front thrust nozzle 4305 and the rear thrust nozzle 4304 are powered by the built in pipe 4306. The curtain nozzles 4307 are also powered by the pipe 4306 via feeder pipes 4308.

Figure 48:
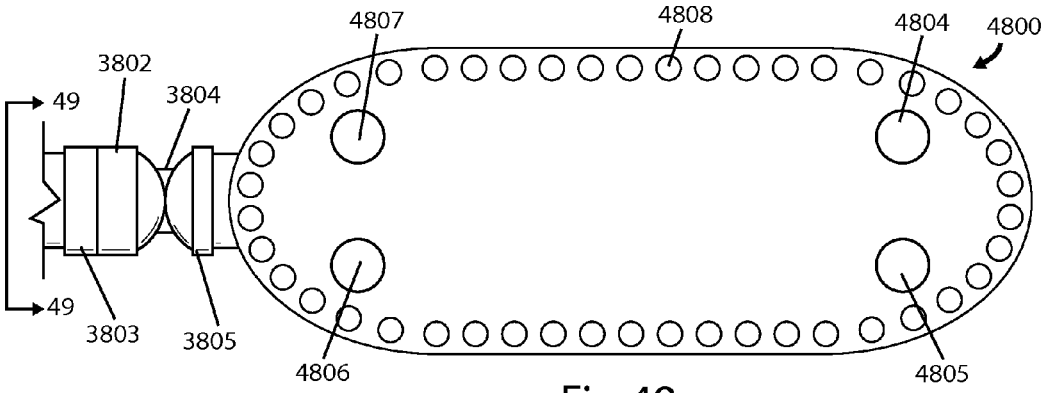
FIG. 48 is a bottom plan view of a four nozzles embodiment.
Figure 49:
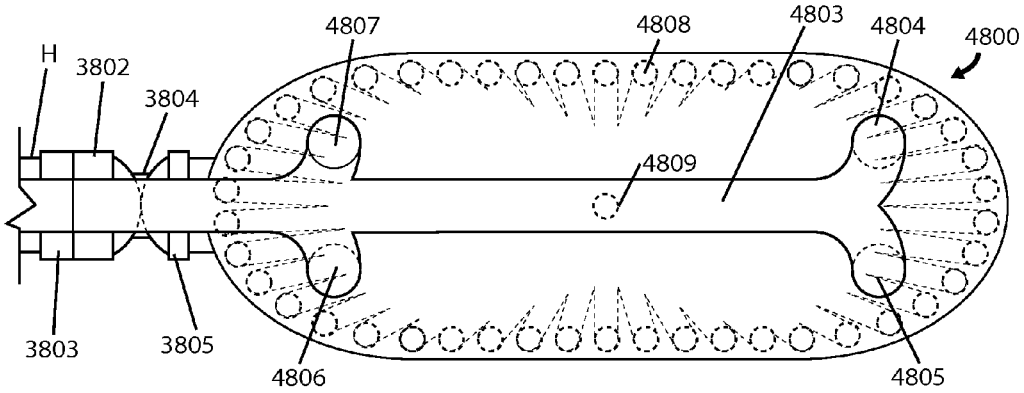
FIG. 49 is a cross sectional view taken along line 49-49 of FIG. 48.
Figure 50:
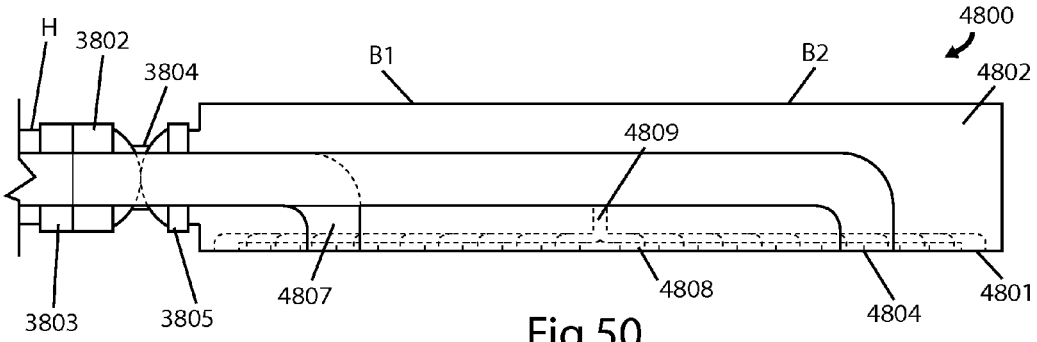
FIG. 50 is a cross sectional view of the FIG. 48 embodiment.

Referring next to FIGS. 48-50 a board 4800 also has a flat bottom 4801 and a one piece housing 4802. A central pipe 4803 powers the front two thrust nozzles 4804, 4805 and the rear two thrust nozzles 4806, 4807. The curtain nozzles 4808 are also powered by central pipe 4803 via feeder pipes 4809. This board 4800 could be a one or two person board.

Figure 51:
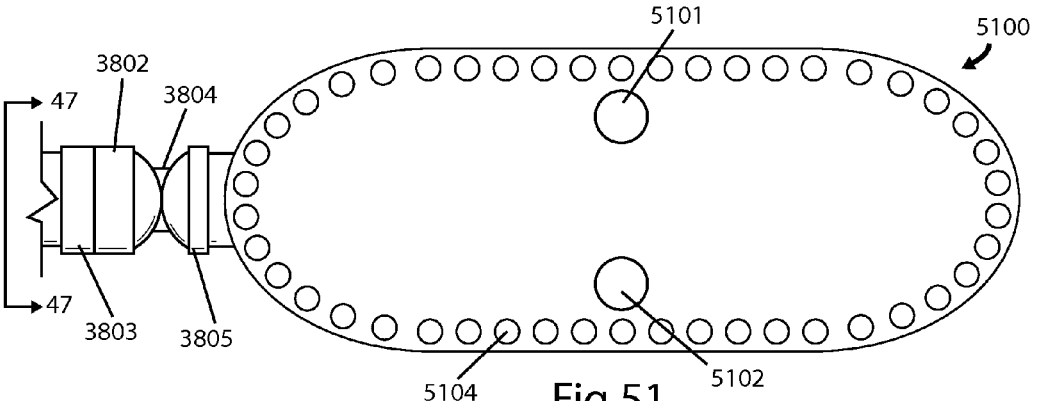
FIG. 51 is a bottom plan view of another side to side nozzle board.
Figure 52:
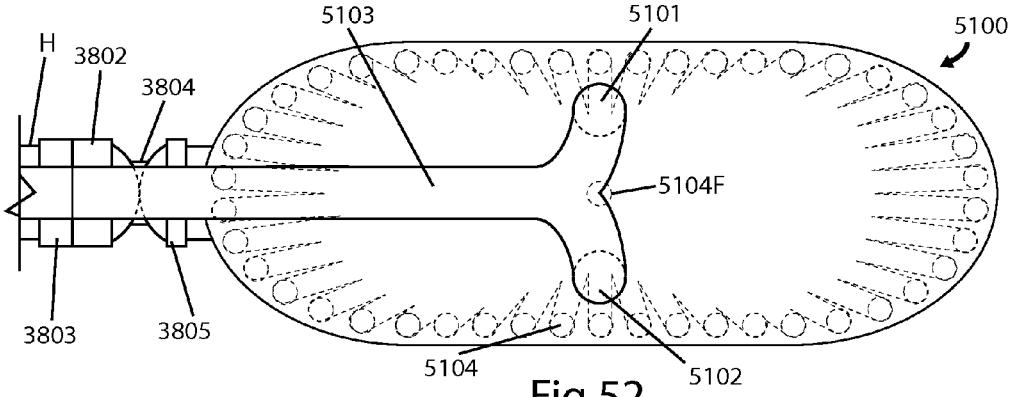
FIG. 52 is a cross sectional view taken along line 52-52 of FIG. 51.
Figure 53:
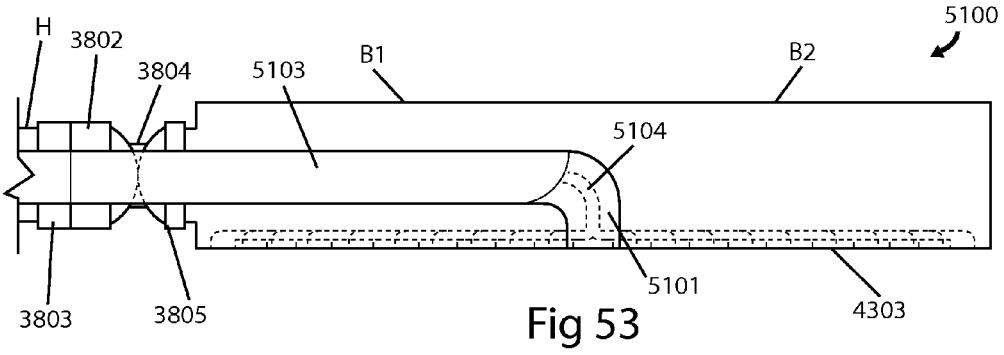
FIG. 53 is a cross sectional view of the FIG. 51 embodiment.

Referring next to FIGS. 51-53 a board 5100 will fly and control as shown in FIGS. 54, 55 due to its side to side thrust nozzles 5101, 5102. The housing 5104 contains a central pipe 5103 to power nozzles 5101, 5102 and curtain nozzles 5104 which are fed by feeder pipes 5104F.

Figure 56:
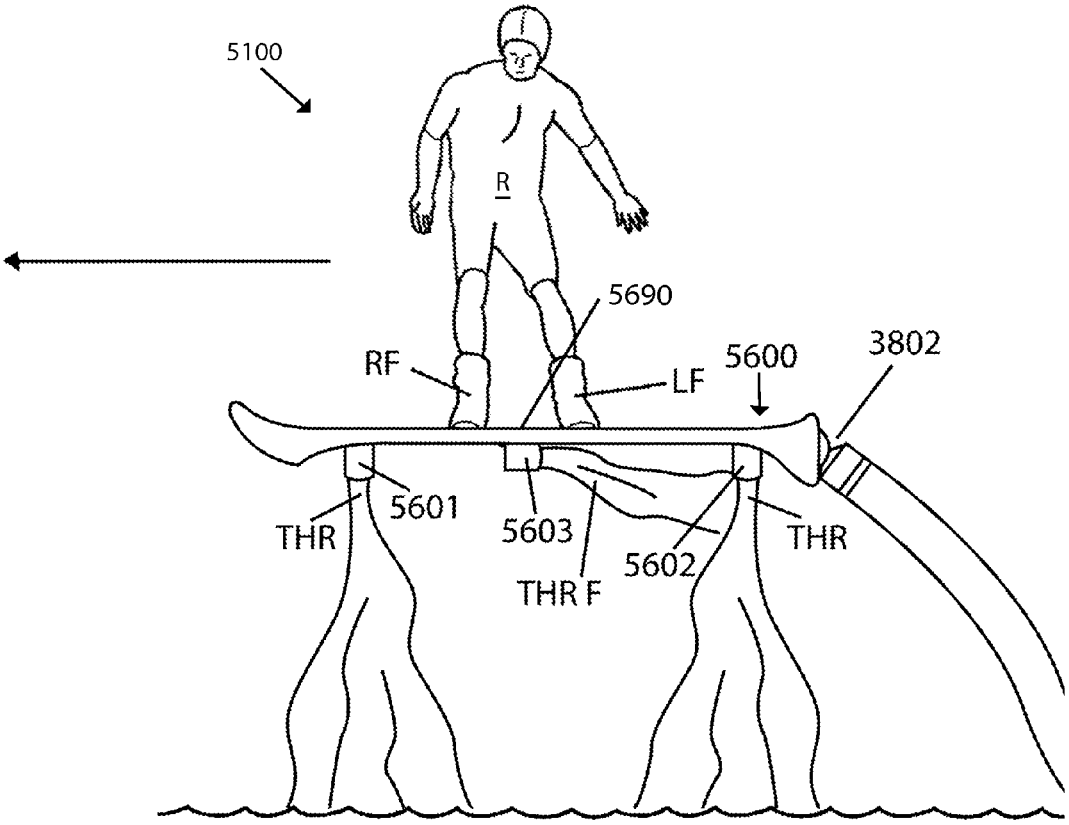
FIG. 56 is a side perspective view of a pivotable nozzle surf and fly embodiment.
Figure 57A:
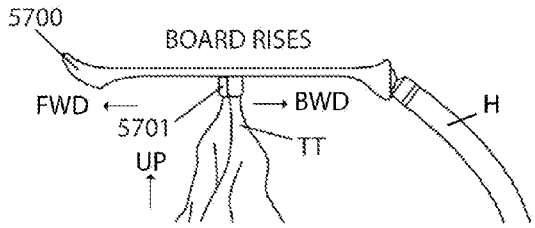
FIG. 57 *a* thru 57*e* show an adjustable nozzle board in various angles of flight.
Figure 57B:
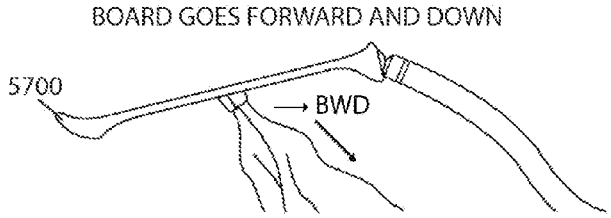
Figure 57C:
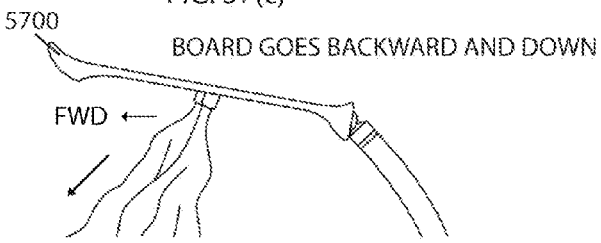
Figure 57D:
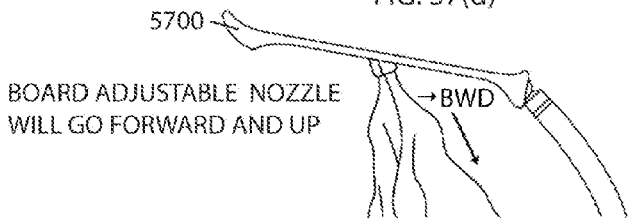
Figure 57E:
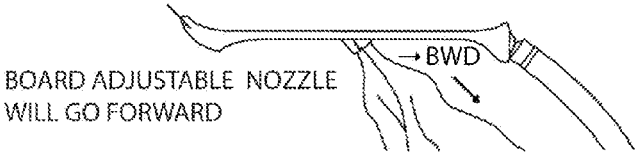

Referring next to FIG. 56 a surf and fly board 5600 has optional fixed flight nozzles 5601, 5602 which provide lift thrust THR. A side to side nozzle pair 5603, 5604 are configured similar to the board 3800 shown in FIG. 38. However, the rider R can rotate this nozzle pair manually using tiller 5690 so as to face the nozzles 5603, 5604 rearward as shown. In this position the nozzles 5603, 5604 provide a forward thrust THRF. The rider R can now perform powered surfing on the surface of the water without flying.

The tiller 5690 may be a hand controlled pivotable rod as shown. Another embodiment (not shown) can use a small handle adjacent the boots to fix the rotating nozzles from a flying to a surfing orientation.

All embodiments could have a motorized jet ski throttle controller on the handle. This would be a wireless controller receiving signals from a rider's transmitter. A kill switch would be integral to this flying rider controlled jet ski embodiment.

Figure 38:
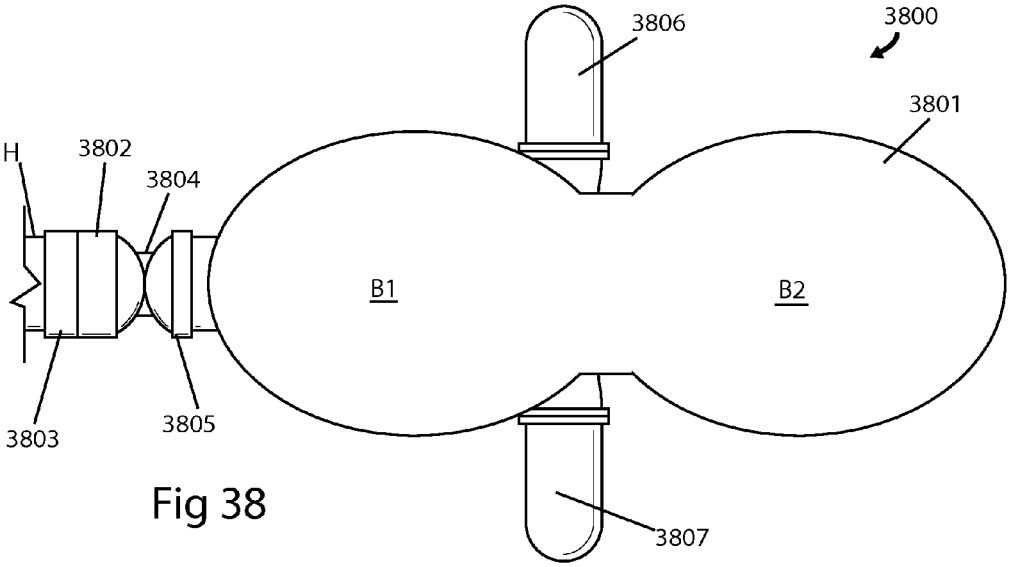
FIG. 38 is a top plan view of a side to side nozzle embodiment.
Figure 39:
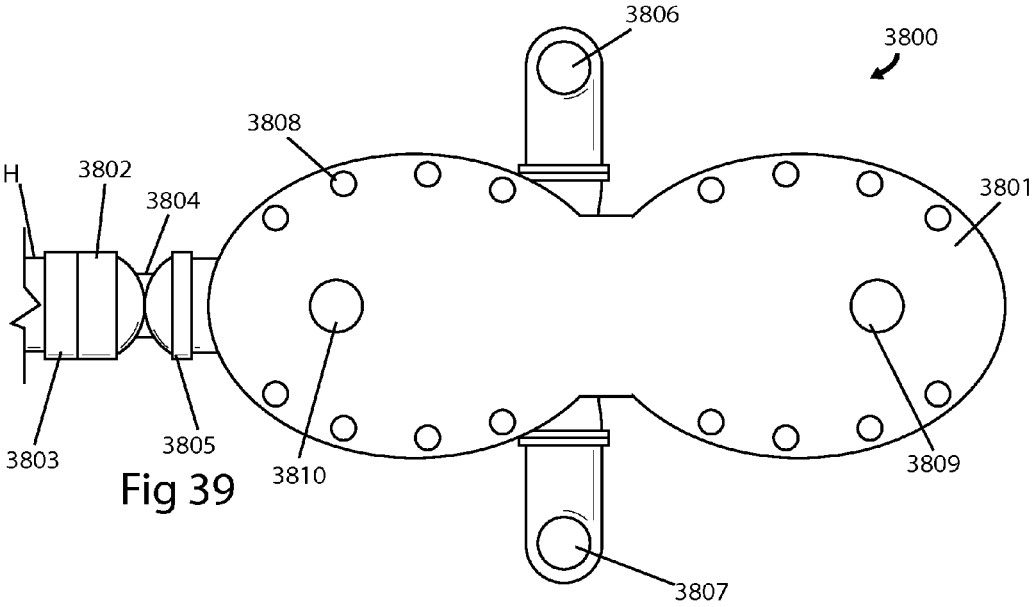
FIG. 39 is a bottom plan view of the FIG. 38 embodiment.

In FIG. 57(*a*) thru (*e*) a flying board 5700 has the side to side nozzle pair as in FIG. 38, but the thrust nozzle pair 5701 are controllably angled backward, see arrow BWD. A second controller (not shown) similar to FIG. 17, perhaps on a glove on the opposite hand, controls the nozzle angle. FIG. 57(*a*) shows the nozzle 5701 angled straight down, forcing the flying board 5700 straight up, per arrow UP with thrust TT. 57(*b*) shows nozzle 5701 backward resulting in board going forward and down. 57(*c*) shows nozzle 5701 forward FWD and board going backward and down. 57(*d*) shows nozzle 5701 backward and board forward and up. 57(*e*) shows nozzle 5701 backward and board going flat and forward.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A water propelled flying board comprising:

a rigid board having a length greater than a width;

said rigid board having a top surface upon which a rider can ride;

said rigid board having a rear end with a high pressure water hose inlet connection;

said rigid board having at least one rearward facing high pressure water outlet nozzle;

a central pipe connecting the water hose inlet connection to the outlet nozzle; and wherein the outlet nozzle, when fed with a high pressure water source from the water hose inlet connection, provides a forward thrust to the water propelled flying board.

2. The water propelled flying board of claim 1, wherein an angled position of the water outlet nozzle provides a lift thrust in addition to a forward thrust.

3. The water propelled flying board of claim 2, wherein the outlet nozzle further comprises an angle adjustment means functioning to adjust the angled position of the water outlet nozzle.

4. The water propelled flying board of claim 3, wherein the angle adjustment means further comprises a handle.

5. The water propelled flying board of claim 1, wherein the at least one rearward facing high pressure water outlet nozzle further comprises two rearward facing high pressure water outlet nozzles.

6. The water propelled flying board of claim 1 further comprising a tiller means functioning to adjust a rearward tilt angle of the rearward facing high pressure water outlet nozzle.

7. The water propelled flying board of claim 1, wherein the central pipe is located centrally along a longitudinal axis of the water propelled flying board.

8. The water propelled flying board of claim 1 further comprising a wireless controller for the rider to control a jet ski which powers the high pressure water.

9. The water propelled flying board of claim 6, wherein a wireless controller controls the tiller means to adjust the rearward tilt angle.

10. The water propelled flying board of claim 1, wherein the high pressure water hose inlet connection further comprises a rotatable bearing allowing the flying board to orient 360° relative to a hose connected to the high pressure water hose inlet.

11. The water propelled flying board of claim 1, wherein the top surface further comprises a mounting means for a rider's feet functioning to hold the rider's feet onto the flying board.

12. The water propelled flying board of claim 2, wherein the high pressure water hose inlet further comprises a quick disconnect fitting.

13. The water propelled flying board of claim 10, wherein the high pressure water hose inlet further comprises a quick disconnect fitting.

14. The water propelled flying board of claim 2 further comprising a source of a high pressure water comprising a jet ski and a high pressure hose connected to the high pressure water hose inlet connection at an outlet end of the hose with a quick disconnect fitting and a rotatable bearing, and an input end of the hose connects to a universal adapter which is attached to a high pressure water outlet port located at a rear of the jet ski.

15. The water propelled flying board of claim 14, wherein the universal adapter further comprises a diverter conduit which then connects to the input end of the hose.

16. The water propelled flying board of claim 15, wherein the universal adapter further comprises a mounting means functioning to provide a removable connection to a standard jet ski nozzle and a removable connection to the diverter conduit, one at a time, to an exit port of the universal adapter.

* * * * *